US008319703B2

(12) United States Patent
Chui

(10) Patent No.: US 8,319,703 B2
(45) Date of Patent: Nov. 27, 2012

(54) RENDERING AN IMAGE PIXEL IN A COMPOSITE DISPLAY

(75) Inventor: Clarence Chui, San Jose, CA (US)

(73) Assignee: Qualcomm Mems Technologies, Inc., San Diego, CA (US)

( * ) Notice: Subject to any disclaimer, the term of this patent is extended or adjusted under 35 U.S.C. 154(b) by 867 days.

(21) Appl. No.: 11/906,774

(22) Filed: Oct. 2, 2007

(65) Prior Publication Data

US 2009/0002290 A1 Jan. 1, 2009

Related U.S. Application Data

(60) Provisional application No. 60/966,549, filed on Jun. 28, 2007.

(51) Int. Cl.

| | |
|---|---|
| ***G09G 3/00*** | (2006.01) |
| ***G09G 3/04*** | (2006.01) |
| ***G09G 3/06*** | (2006.01) |
| ***G09G 3/14*** | (2006.01) |
| ***G09G 3/16*** | (2006.01) |
| ***G09G 3/30*** | (2006.01) |
| ***G09G 3/32*** | (2006.01) |

(52) U.S. Cl. ..... 345/31; 345/30; 345/33; 345/44; 345/46; 345/48; 345/77; 345/82

(58) Field of Classification Search ..... 345/30–48, 345/82–87, 690–699

See application file for complete search history.

(56) References Cited

U.S. PATENT DOCUMENTS

| | | | | |
|---|---|---|---|---|
| 1,725,851 | A | | 8/1929 | Craig |
| 2,036,147 | A | | 3/1936 | Klema |
| 2,951,617 | A | | 9/1960 | Brock |
| 3,246,410 | A | | 4/1966 | Festa |
| 3,465,586 | A | | 9/1969 | Johnston |
| 4,160,973 | A | * | 7/1979 | Berlin, Jr. ..... 345/31 |
| 4,296,930 | A | | 10/1981 | Frederiksen |
| 4,298,868 | A | | 11/1981 | Spurgeon |
| 4,311,999 | A | | 1/1982 | Upton et al. |
| 4,471,351 | A | | 9/1984 | Anderson |
| 4,689,604 | A | | 8/1987 | Sokol |
| 4,821,208 | A | | 4/1989 | Ryan et al. |
| 5,016,213 | A | | 5/1991 | Dilts et al. |
| 5,057,827 | A | | 10/1991 | Nobile et al. |

(Continued)

FOREIGN PATENT DOCUMENTS

CN 102187679 9/2011

(Continued)

OTHER PUBLICATIONS

SpaceWriter, Lighting Kinetics, FanScreen, Jul. 25, 2002: http://web.archive.org/web/20020725092751/http:/www.spacewriter.com/.

(Continued)

*Primary Examiner* — Bipin Shalwala
*Assistant Examiner* — Ryan A Lubit
(74) *Attorney, Agent, or Firm* — Weaver Austin Villeneuve & Sampson LLP

(57) ABSTRACT

Rendering an image pixel in a composite display is disclosed. In some embodiments, an image pixel is mapped to a plurality of temporal pixels, and the image pixel is rendered in a composite display using at least a subset of the plurality of temporal pixels to which it is mapped, with the intensity of the image pixel spread across the subset of temporal pixels.

40 Claims, 21 Drawing Sheets

U.S. PATENT DOCUMENTS 5,101,439 A 3/1992 Kiang
5,115,229 A 5/1992 Shalit
5,190,491 A 3/1993 Connelly
5,381,236 A 1/1995 Morgan
5,444,456 A 8/1995 Ohta et al.
5,576,761 A 11/1996 Iwamoto
5,717,416 A 2/1998 Chakrabarti
5,748,157 A 5/1998 Eason
5,791,966 A 8/1998 Capps et al.
5,800,039 A 9/1998 Lee
5,864,331 A 1/1999 Anand et al.
5,886,728 A 3/1999 Hamada et al.
5,929,842 A 7/1999 Vertregt et al.
5,959,617 A 9/1999 Bird et al.
5,990,498 A 11/1999 Chapnik et al.
5,992,498 A 11/1999 Boston
6,028,593 A 2/2000 Rosenberg et al.
6,037,876 A 3/2000 Crouch
6,116,762 A 9/2000 Kutlucinar
6,164,780 A 12/2000 Noto et al.
6,193,384 B1 2/2001 Stein
6,243,059 B1 6/2001 Greene et al.
6,243,149 B1 6/2001 Swanson et al.
6,249,998 B1 6/2001 NakaMats
6,265,984 B1 7/2001 Molinaroli
6,275,615 B1 8/2001 Ida et al.
6,320,325 B1 11/2001 Cok et al.
6,335,714 B1 1/2002 Wang
6,404,409 B1 6/2002 Solomon
6,475,153 B1 11/2002 Khair et al.
6,492,963 B1 12/2002 Hoch
6,508,022 B2 1/2003 Huang
6,525,668 B1 2/2003 Petrick
6,559,858 B1 5/2003 Schneider et al.
6,575,585 B2 6/2003 Nelson et al.
6,697,034 B2 * 2/2004 Tashman ..... 345/31
6,712,471 B1 3/2004 Travis et al.
6,856,303 B2 2/2005 Kowalewski
6,928,137 B2 8/2005 Bruder et al.
6,955,449 B2 10/2005 Martineau
7,027,054 B1 4/2006 Cheiky et al.
7,033,035 B2 4/2006 Fatemi et al.
7,082,591 B2 7/2006 Carlson
7,096,046 B2 8/2006 Shapiro et al.
7,099,701 B2 8/2006 Lo et al.
7,101,153 B2 9/2006 Cartwright
7,113,165 B2 9/2006 Vincent et al.
7,164,810 B2 1/2007 Schnee et al.
7,175,305 B2 2/2007 Martineau
7,237,924 B2 7/2007 Martineau et al.
7,267,444 B2 9/2007 Black, Jr.
7,271,813 B2 9/2007 Gilbert
7,361,074 B1 4/2008 Periman et al.
7,397,387 B2 7/2008 Suzuki et al.
7,553,051 B2 6/2009 Brass et al.
7,703,946 B2 4/2010 Chiang et al.
7,714,923 B2 5/2010 Cok et al.
7,740,359 B2 6/2010 Schnuckle et al.
7,758,214 B2 7/2010 Lee et al.
7,837,358 B2 11/2010 Liao
7,871,192 B2 1/2011 Chien
7,872,631 B2 1/2011 Feng et al.
7,911,411 B2 3/2011 Yoshikawa et al.
8,106,854 B2 1/2012 Chui
8,106,860 B2 1/2012 Chui
8,111,209 B2 2/2012 Chui
2001/0023547 A1 9/2001 Huang
2001/0048406 A1 12/2001 Masumoto et al.
2002/0005826 A1 * 1/2002 Pederson ..... 345/82
2002/0140631 A1 10/2002 Blundell
2002/0176625 A1 11/2002 Porikli et al.
2003/0160739 A1 8/2003 Silic
2003/0164807 A1 9/2003 Glatzer
2003/0184513 A1 10/2003 Janssen
2003/0218881 A1 11/2003 Hansen et al.
2003/0234759 A1 12/2003 Bergquist
2004/0102223 A1 5/2004 Lo et al.
2004/0105256 A1 6/2004 Jones
2004/0105573 A1 6/2004 Neumann et al.
2004/0114714 A1 6/2004 Minyard et al.
2004/0140981 A1 7/2004 Clark
2004/0141581 A1 7/2004 Bruder et al.
2004/0188687 A1 9/2004 Arnold et al.
2004/0196225 A1 10/2004 Shimada
2004/0262393 A1 12/2004 Hara et al.
2005/0030305 A1 2/2005 Brown et al.
2005/0052404 A1 3/2005 Kim et al.
2005/0110728 A1 5/2005 Cok
2005/0174780 A1 8/2005 Park
2005/0237272 A1 10/2005 Josephson et al.
2005/0264472 A1 12/2005 Rast
2006/0001384 A1 1/2006 Tain et al.
2006/0006524 A1 1/2006 Hsieh
2006/0007011 A1 1/2006 Chivarov
2006/0007206 A1 1/2006 Reddy et al.
2006/0038831 A1 2/2006 Gilbert
2006/0081869 A1 4/2006 Lu et al.
2006/0092639 A1 5/2006 Livesay et al.
2006/0119592 A1 6/2006 Wang et al.
2006/0152524 A1 7/2006 Miller et al.
2006/0164382 A1 7/2006 Kulas et al.
2006/0244741 A1 11/2006 Kimura et al.
2006/0274286 A1 12/2006 Morejon et al.
2007/0035707 A1 2/2007 Margulis
2007/0046924 A1 3/2007 Chang
2007/0051881 A1 3/2007 Ashdown
2007/0177817 A1 8/2007 Szeliski et al.
2007/0296924 A1 12/2007 Ishii et al.
2008/0043014 A1 2/2008 Tachi et al.
2008/0062161 A1 3/2008 Brown
2008/0068297 A1 3/2008 Gilbert
2008/0068799 A1 3/2008 Chan
2008/0094323 A1 4/2008 Sirmon et al.
2008/0106628 A1 5/2008 Cok et al.
2008/0222932 A1 9/2008 Yun et al.
2008/0253125 A1 10/2008 Kang et al.
2008/0303747 A1 12/2008 Velicescu
2009/0002270 A1 1/2009 Chui
2009/0002271 A1 1/2009 Chui
2009/0002272 A1 1/2009 Chui
2009/0002273 A1 1/2009 Chui
2009/0002288 A1 1/2009 Chui
2009/0002289 A1 1/2009 Chui
2009/0002293 A1 1/2009 Chui
2009/0002362 A1 1/2009 Chui
2009/0046258 A1 2/2009 Schnuckle et al.
2009/0104969 A1 4/2009 Paulsen et al.
2009/0115794 A1 5/2009 Fukuta
2009/0323341 A1 12/2009 Chui
2010/0019993 A1 1/2010 Chui
2010/0019997 A1 1/2010 Chui
2010/0020107 A1 1/2010 Chui
2010/0097448 A1 4/2010 Gilbert et al.
2010/0301372 A1 12/2010 Loh
2012/0092396 A1 4/2012 Chui

FOREIGN PATENT DOCUMENTS

DE 102006030890 5/2007
EP 1335430 8/2003
EP 2167999 3/2010
EP 2342899 7/2011
EP 2390867 11/2011
EP 2395499 12/2011
JP 2006252777 A 9/2006
JP 2011529204 12/2011
TW 200917179 4/2009
WO 00/17843 3/2000
WO 03/021565 3/2003
WO 03/077013 9/2003
WO 2006/021788 3/2006
WO 2004/097783 11/2007
WO 2009005754 1/2009
WO 2009005756 1/2009
WO 2009005757 1/2009
WO 2009005762 1/2009
WO 2010011303 1/2010

OTHER PUBLICATIONS

SpaceWriter, WallScreen, Dec. 7, 2003: http://web.archive.org/web/20031207125205/www.spacewriter.com/wallscreen.asp?menuproduct=WS.
An Analog & Digital propeller clock I made! It isn't Real its just because your so awfully slow!!!;-) 1997 Bob Blick pp. 1-26 http://www.luberth.com/analog.htm.
U.S. Office Action mailed Sep. 17, 2010, from U.S. Appl. No. 11/906,770.
U.S. Office Action mailed Sep. 28, 2010, from U.S. Appl. No. 11/906,772.
U.S. Office Action mailed Sep. 23, 2010, from U.S. Appl. No. 11/906,773.
U.S. Office Action mailed Sep. 3, 2010, from U.S. Appl. No. 11/906,775.
U.S. Office Action mailed Jan. 31, 2011, from U.S. Appl. No. 12/008,700.
U.S. Office Action mailed Feb. 9, 2011, from U.S. Appl. No. 12/008,711.
U.S. Office Action mailed Feb. 14, 2011, from U.S. Appl. No. 12/008,712.
U.S. Office Action mailed Dec. 6, 2010, from U.S. Appl. No. 12/099,843.
International Search Report and Written Opinion mailed Oct. 7, 2008, from Application No. PCT/US2008/008111.
International Preliminary Report on Patentability mailed Jan. 5, 2010, from Application No. PCT/US2008/008111.
International Search Report and Written Opinion mailed Sep. 29, 2008, from Application No. PCT/US2008/008102.
International Preliminary Report on Patentability mailed Jan. 5, 2010, from Application No. PCT/US2008/008102.
International Search Report and Written Opinion mailed Oct. 7, 2008, from Application No. PCT/US2008/008106.
International Preliminary Report on Patentability mailed Jan. 5, 2010, from Application No. PCT/US2008/008106.
International Search Report and Written Opinion mailed Oct. 1, 2008, from Application No. PCT/US2008/008098.
International Preliminary Report on Patentability mailed Jan. 5, 2010, from Application No. PCT/US2008/008098.
International Search Report and Written Opinion mailed Nov. 16, 2009, from Application No. PCT/US2009/004245.
International Preliminary Report on Patentability mailed Jan. 25, 2011, from Application No. PCT/US2009/004245.
U.S. Final Office Action mailed Apr. 12, 2011, from U.S. Appl. No. 11/906,770.
U.S. Final Office Action mailed Apr. 12, 2011, from U.S. Appl. No. 11/906,772.
U.S. Final Office Action mailed Apr. 26, 2011, from U.S. Appl. No. 11/906,773.
U.S. Final Office Action mailed May 12, 2011, from U.S. Appl. No. 11/906,775.
U.S. Office Action mailed Jun. 2, 2011, from U.S. Appl. No. 12/008,700.
U.S. Final Office Action mailed Jun. 2, 2011, from U.S. Appl. No. 12/008,711.
U.S. Final Office Action mailed Jun. 15, 2011, from U.S. Appl. No. 12/008,712.
U.S. Notice of Allowance mailed May 31, 2011, from U.S. Appl. No. 12/009,843.
U.S. Office Action mailed May 26, 2011, from U.S. Appl. No. 12/220,443.
U.S. Office Action mailed Jun. 15, 2011, from U.S. Appl. No. 12/220,444.
U.S. Office Action mailed Jun. 9, 2011, from U.S. Appl. No. 12/220,443.
U.S. Office Action mailed Apr. 4, 2011, from U.S. Appl. No. 12/380,588.
U.S. Notice of Allowance mailed Aug. 19, 2011, from U.S. Appl. No. 11/906,770.
U.S. Advisory Action mailed Jul. 26, 2011, from U.S. Appl. No. 11/906,775.
U.S. Notice of Allowance mailed Oct. 20, 2011, from U.S. Appl. No. 12/008,700.
U.S. Notice of Allowance mailed Oct. 19, 2011, from U.S. Appl. No. 12/008,711.
U.S. Office Action mailed Sep. 29, 2011, from U.S. Appl. No. 12/008,712.
U.S. Office Action mailed Jul. 5, 2011, from U.S. Appl. No. 12/099,843.
U.S. Final Office Action mailed Oct. 24, 2011, from U.S. Appl. No. 12/220,443.
U.S. Final Office Action mailed Oct. 21, 2011, from U.S. Appl. No. 12/220,444.
U.S. Final Office Action mailed Oct. 17, 2011, from U.S. Appl. No. 12/220,447.
U.S. Final Office Action mailed Aug. 22, 2011, from U.S. Appl. No. 12/380,588.
European Extended Search Report mailed Nov. 15, 2011, from Application No. 11164990.1-2205.
European Extended Search Report mailed Nov. 2, 2011, from Application No. 11164973.7-2205.
U.S. Final Office Action mailed Apr. 25, 2012, from U.S. Appl. No. 12/220,444.
U.S. Final Office Action mailed Jun. 6, 2012, from U.S. Appl. No. 11/906,773.
U.S. Final Office Action mailed May 14, 2012, from U.S. Appl. No. 11/906,772.
U.S. Final Office Action mailed May 21, 2012, from U.S. Appl. No. 13/333,935.
U.S. Final Office Action mailed May 3, 2012, from U.S. Appl. No. 12/220,443.
U.S. Office Action mailed Feb. 24, 2012, from U.S. Appl. No. 12/008,712.
U.S. Office Action mailed Jan. 20, 2012, from U.S. Appl. No. 12/009,843.
U.S. Office Action mailed Jun. 19, 2012, from U.S. Appl. No. 12/380,588.
U.S. Office Action mailed Mar. 29, 2012, from U.S. Appl. No. 12/220,447.
U.S. Office Action mailed May 30, 2012, from U.S. Appl. No. 12/009,843.
U.S. Office Action mailed Jun. 29, 2012, from U.S. Appl. No. 12/008,712.

* cited by examiner

RENDERING AN IMAGE PIXEL IN A COMPOSITE DISPLAY

CROSS REFERENCE TO OTHER APPLICATIONS

This application claims priority to U.S. Provisional Patent Application No. 60/966,549 entitled COMPOSITE DISPLAY filed Jun. 28, 2007, which application is incorporated herein by reference for all purposes.

BACKGROUND OF THE INVENTION

Digital displays are used to display images or video to provide advertising or other information. For example, digital displays may be used in billboards, bulletins, posters, highway signs, and stadium displays. Digital displays that use liquid crystal display (LCD) or plasma technologies are limited in size because of size limits of the glass panels associated with these technologies. Larger digital displays typically comprise a grid of printed circuit board (PCB) tiles, where each tile is populated with packaged light emitting diodes (LEDs). Because of the space required by the LEDs, the resolution of these displays is relatively coarse. Also, each LED corresponds to a pixel in the image, which can be expensive for large displays. In addition, a complex cooling system is typically used to sink heat generated by the LEDs, which may burn out at high temperatures. As such, improvements to digital display technology are needed.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process, an apparatus, a system, a composition of matter, a computer readable medium such as a computer readable storage medium or a computer network wherein program instructions are sent over optical or communication links. In this specification, these implementations, or any other form that the invention may take, may be referred to as techniques. A component such as a processor or a memory described as being configured to perform a task includes both a general component that is temporarily configured to perform the task at a given time or a specific component that is manufactured to perform the task. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Figure 1:
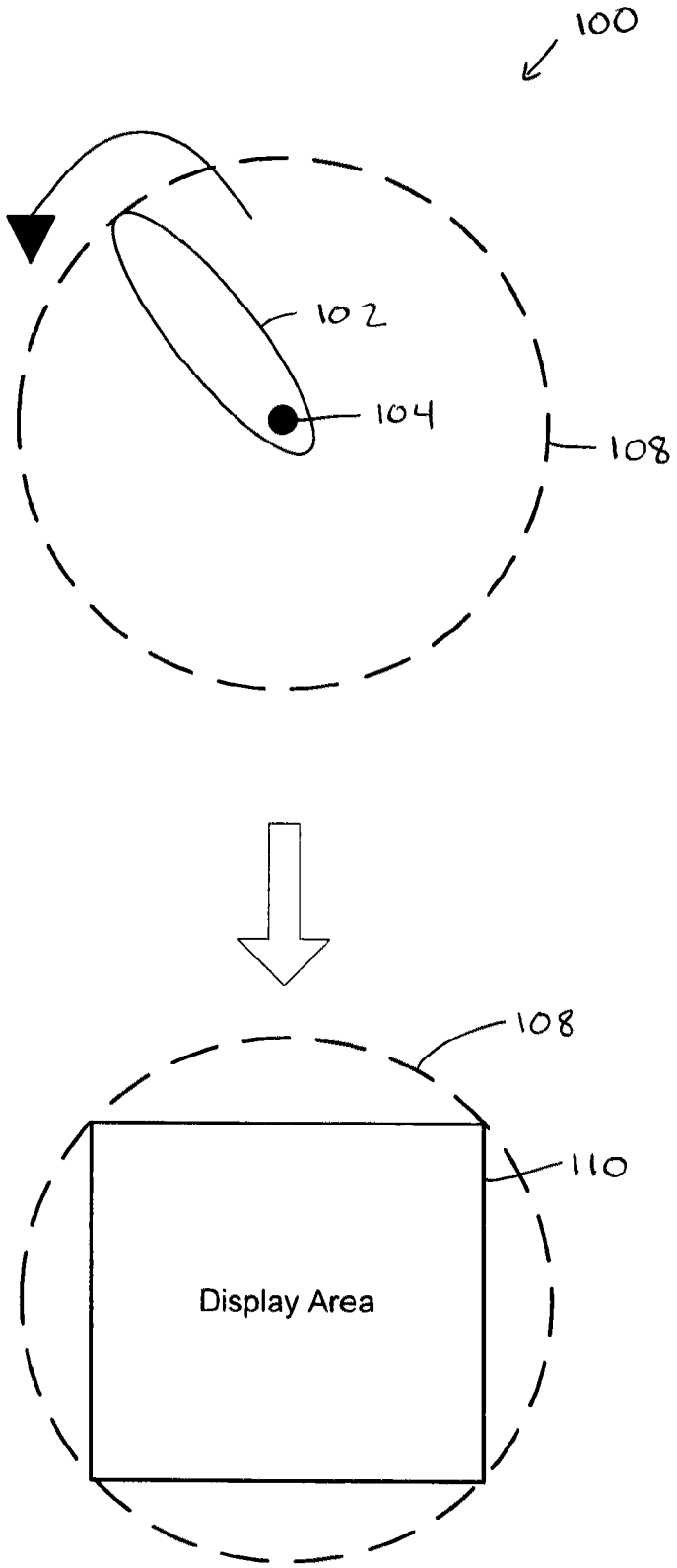
FIG. 1 is a diagram illustrating an embodiment of a composite display 100 having a single paddle.

FIG. 1 is a diagram illustrating an embodiment of a composite display 100 having a single paddle. In the example shown, paddle 102 is configured to rotate at one end about axis of rotation 104 at a given frequency, such as 60 Hz. Paddle 102 sweeps out area 108 during one rotation or paddle cycle. A plurality of pixel elements, such as LEDs, is installed on paddle 102. As used herein, a pixel element refers to any element that may be used to display at least a portion of image information. As used herein, image or image information may include image, video, animation, slideshow, or any other visual information that may be displayed. Other examples of pixel elements include: laser diodes, phosphors, cathode ray tubes, liquid crystal, any transmissive or emissive optical modulator. Although LEDs may be described in the examples herein, any appropriate pixel elements may be used. In various embodiments, LEDS may be arranged on paddle 102 in a variety of ways, as more fully described below.

As paddle 102 sweeps out area 108, one or more of its LEDs are activated at appropriate times such that an image or a part thereof is perceived by a viewer who is viewing swept area 108. An image is comprised of pixels each having a spatial location. It can be determined at which spatial location a particular LED is at any given point in time. As paddle 102 rotates, each LED can be activated as appropriate when its location coincides with a spatial location of a pixel in the image. If paddle 102 is spinning fast enough, the eye perceives a continuous image. This is because the eye has a poor frequency response to luminance and color information. The eye integrates color that it sees within a certain time window. If a few images are flashed in a fast sequence, the eye integrates that into a single continuous image. This low temporal sensitivity of the eye is referred to as persistence of vision.

As such, each LED on paddle 102 can be used to display multiple pixels in an image. A single pixel in an image is mapped to at least one "temporal pixel" in the display area in composite display 100. A temporal pixel can be defined by a pixel element on paddle 102 and a time (or angular position of the paddle), as more fully described below.

The display area for showing the image or video may have any shape. For example, the maximum display area is circular and is the same as swept area 108. A rectangular image or video may be displayed within swept area 108 in a rectangular display area 110 as shown.

Figure 2A:
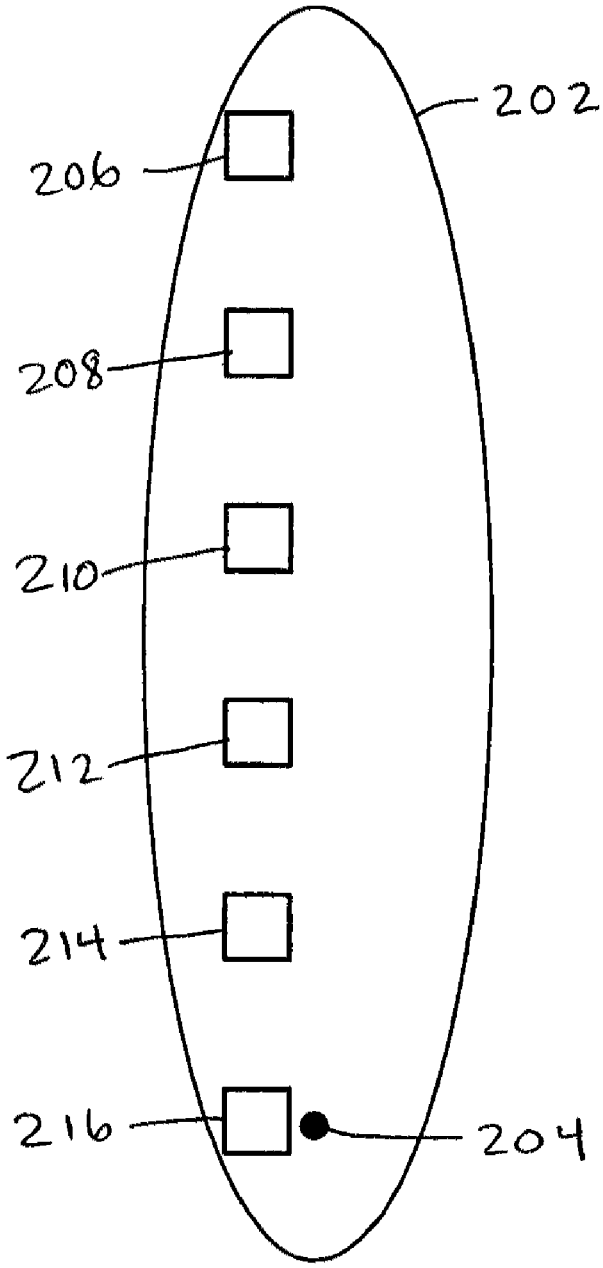
FIG. 2A is a diagram illustrating an embodiment of a paddle used in a composite display.

FIG. 2A is a diagram illustrating an embodiment of a paddle used in a composite display. For example, paddle 202, 302, or 312 (discussed later) may be similar to paddle 102. Paddle 202 is shown to include a plurality of LEDs 206-216 and an axis of rotation 204 about which paddle 202 rotates. LEDs 206-216 may be arranged in any appropriate way in various embodiments. In this example, LEDs 206-216 are arranged such that they are evenly spaced from each other and aligned along the length of paddle 202. They are aligned on the edge of paddle 202 so that LED 216 is adjacent to axis of rotation 204. This is so that as paddle 202 rotates, there is no blank spot in the middle (around axis of rotation 204). In some embodiments, paddle 202 is a PCB shaped like a paddle. In some embodiments, paddle 202 has an aluminum, metal, or other material casing for reinforcement.

Figure 2B:
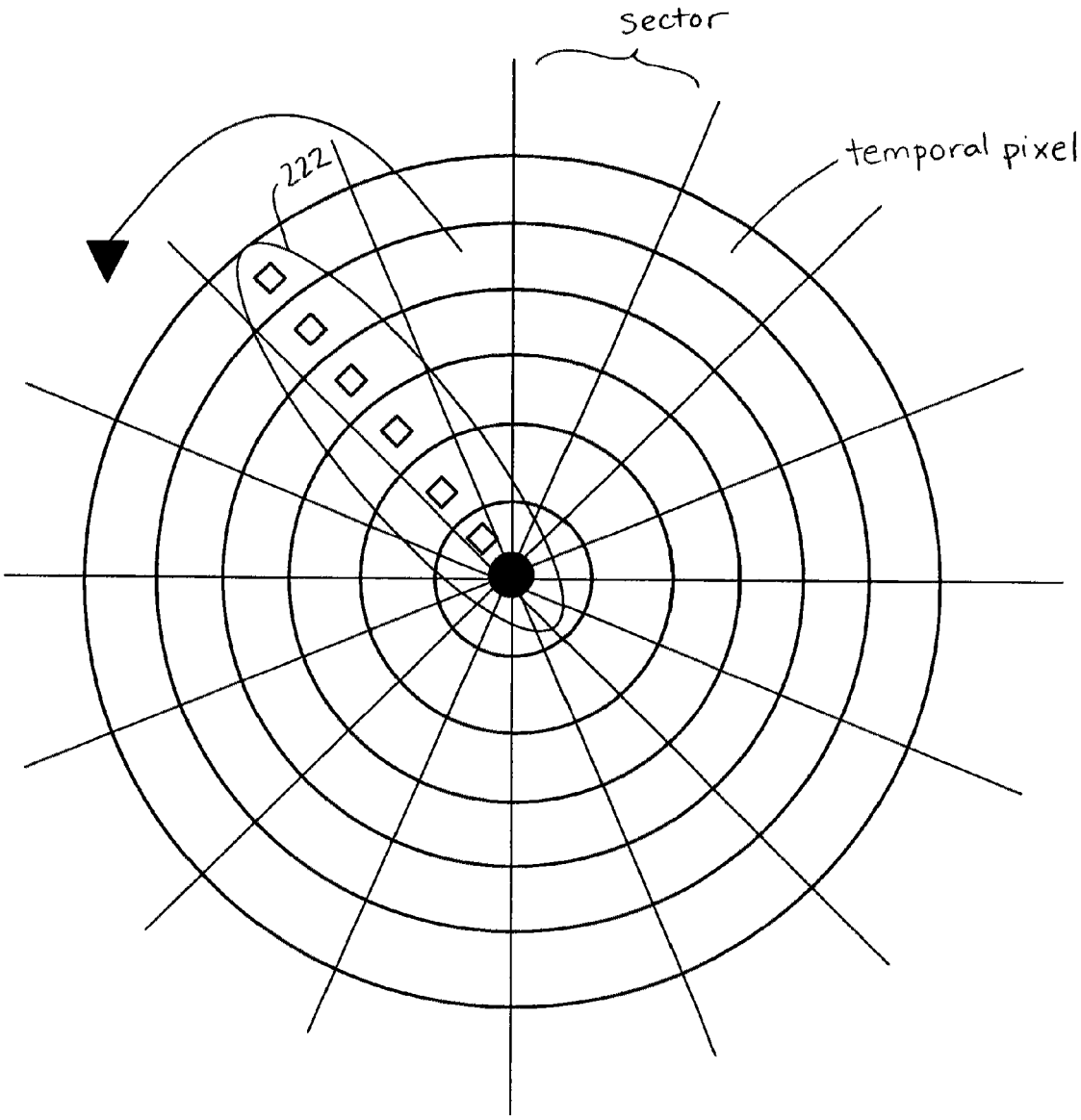
FIG. 2B illustrates an example of temporal pixels in a sweep plane.

FIG. 2B illustrates an example of temporal pixels in a sweep plane. In this example, each LED on paddle 222 is associated with an annulus (area between two circles) around the axis of rotation. Each LED can be activated once per sector (angular interval). Activating an LED may include, for example, turning on the LED for a prescribed time period (e.g., associated with a duty cycle) or turning off the LED. The intersections of the concentric circles and sectors form areas that correspond to temporal pixels. In this example, each temporal pixel has an angle of 42.5 degrees, so that there are a total of 16 sectors during which an LED may be turned on to indicate a pixel. Because there are 6 LEDs, there are 6*16=96 temporal pixels. In another example, a temporal pixel may have an angle of 1/10 of a degree, so that there are a total of 3600 angular positions possible.

Because the spacing of the LEDs along the paddle is uniform in the given example, temporal pixels get denser towards the center of the display (near the axis of rotation). Because image pixels are defined based on a rectangular coordinate system, if an image is overlaid on the display, one image pixel may correspond to multiple temporal pixels close to the center of the display. Conversely, at the outermost portion of the display, one image pixel may correspond to one or a fraction of a temporal pixel. For example, two or more image pixels may fit within a single temporal pixel. In some embodiments, the display is designed (e.g., by varying the sector time or the number/placement of LEDs on the paddle) so that at the outermost portion of the display, there is at least one temporal pixel per image pixel. This is to retain in the display the same level of resolution as the image. In some embodiments, the sector size is limited by how quickly LED control data can be transmitted to an LED driver to activate LED(s). In some embodiments, the arrangement of LEDs on the paddle is used to make the density of temporal pixels more uniform across the display. For example, LEDs may be placed closer together on the paddle the farther they are from the axis of rotation.

Figure 3:
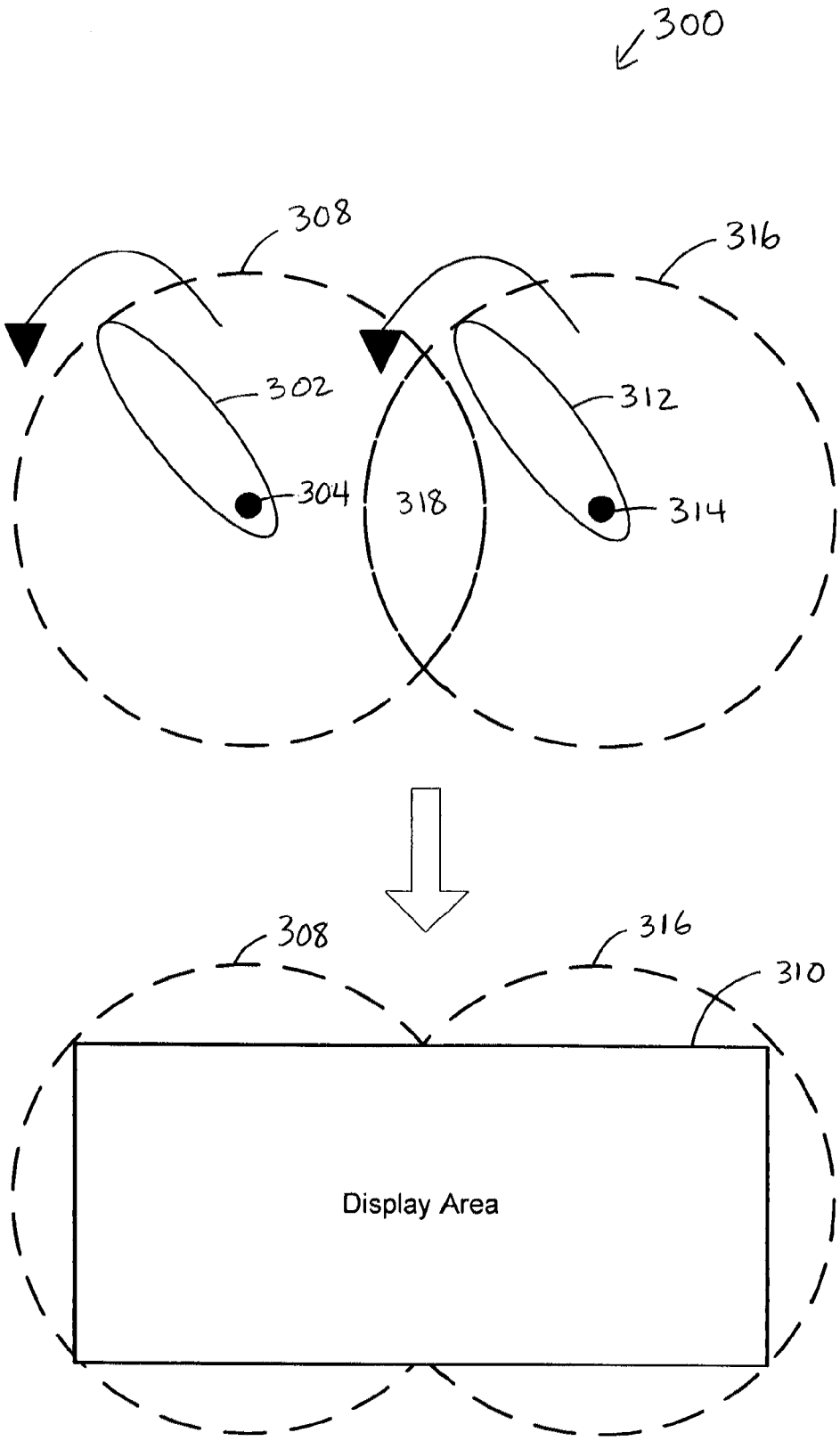
FIG. 3 is a diagram illustrating an embodiment of a composite display 300 having two paddles.

FIG. 3 is a diagram illustrating an embodiment of a composite display 300 having two paddles. In the example shown, paddle 302 is configured to rotate at one end about axis of rotation 304 at a given frequency, such as 60 Hz. Paddle 302 sweeps out area 308 during one rotation or paddle cycle. A plurality of pixel elements, such as LEDs, is installed on paddle 302. Paddle 312 is configured to rotate at one end about axis of rotation 314 at a given frequency, such as 60 Hz. Paddle 312 sweeps out area 316 during one rotation or paddle cycle. A plurality of pixel elements, such as LEDs, is installed on paddle 312. Swept areas 308 and 316 have an overlapping portion 318.

Using more than one paddle in a composite display may be desirable in order to make a larger display. For each paddle, it can be determined at which spatial location a particular LED is at any given point in time, so any image can be represented by a multiple paddle display in a manner similar to that described with respect to FIG. 1. In some embodiments, for overlapping portion 318, there will be twice as many LEDs passing through per cycle than in the nonoverlapping portions. This may make the overlapping portion of the display appear to the eye to have higher luminance. Therefore, in some embodiments, when an LED is in an overlapping portion, it may be activated half the time so that the whole display area appears to have the same luminance. This and other examples of handling overlapping areas are more fully described below.

The display area for showing the image or video may have any shape. The union of swept areas 308 and 316 is the maximum display area. A rectangular image or video may be displayed in rectangular display area 310 as shown.

Figure 4A:
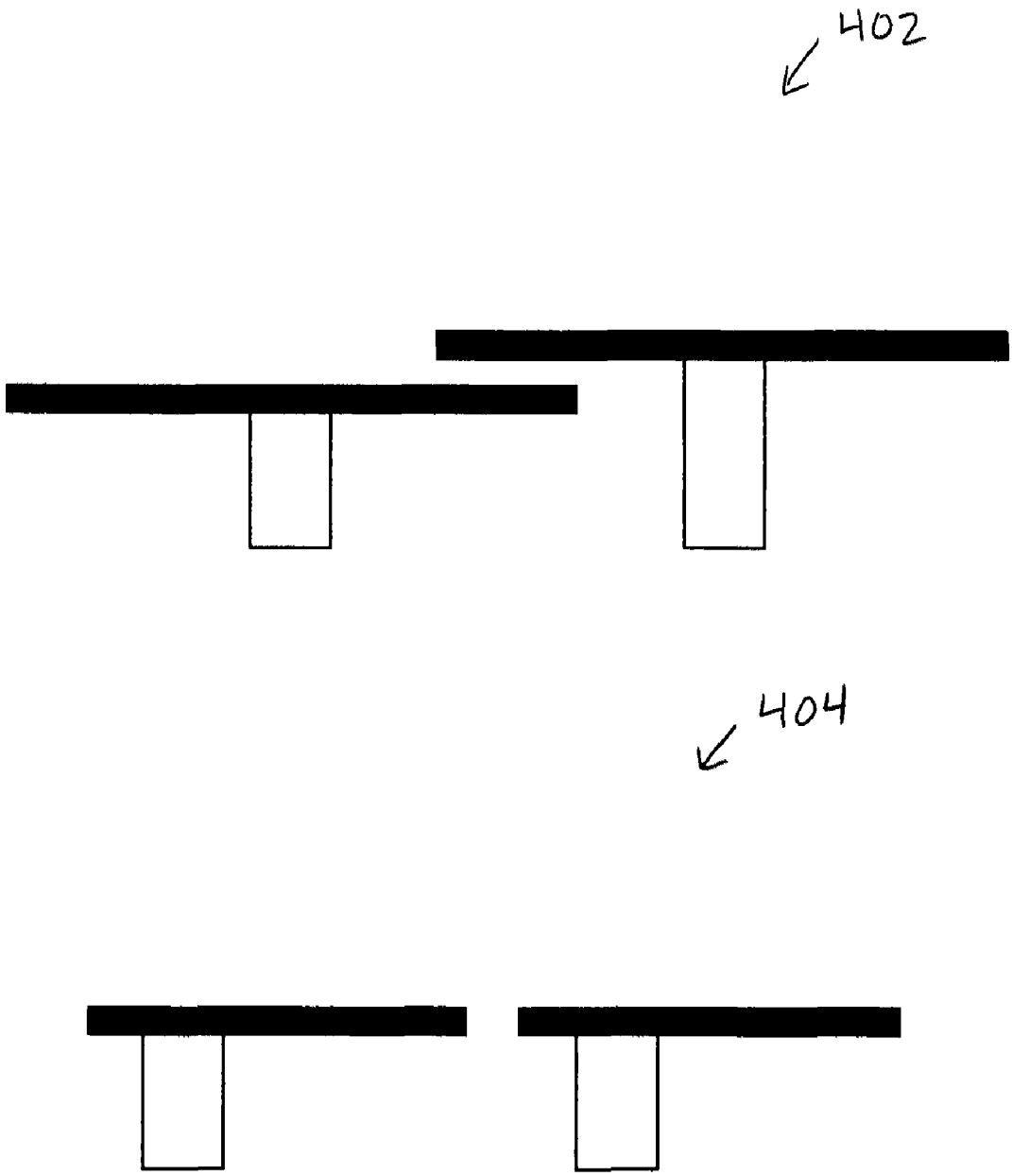
FIG. 4A illustrates examples of paddle installations in a composite display.

When using more than one paddle, there are various ways to ensure that adjacent paddles do not collide with each other. FIG. 4A illustrates examples of paddle installations in a composite display. In these examples, a cross section of adjacent paddles mounted on axes is shown.

In diagram 402, two adjacent paddles rotate in vertically separate sweep planes, ensuring that the paddles will not collide when rotating. This means that the two paddles can rotate at different speeds and do not need to be in phase with each other. To the eye, having the two paddles rotate in different sweep planes is not detectable if the resolution of the display is sufficiently smaller than the vertical spacing between the sweep planes. In this example, the axes are at the center of the paddles. This embodiment is more fully described below.

In diagram 404, the two paddles rotate in the same sweep plane. In this case, the rotation of the paddles is coordinated to avoid collision. For example, the paddles are rotated in phase with each other. Further examples of this are more fully described below.

In the case of the two paddles having different sweep planes, when viewing display area 310 from a point that is not normal to the center of display area 310, light may leak in diagonally between sweep planes. This may occur, for example, if the pixel elements emit unfocused light such that light is emitted at a range of angles. In some embodiments, a mask is used to block light from one sweep plane from being visible in another sweep plane. For example, a mask is placed behind paddle 302 and/or paddle 312. The mask may be attached to paddle 302 and/or 312 or stationary relative to paddle 302 and/or paddle 312. In some embodiments, paddle 302 and/or paddle 312 is shaped differently from that shown in FIGS. 3 and 4A, e.g., for masking purposes. For example, paddle 302 and/or paddle 312 may be shaped to mask the sweep area of the other paddle.

Figure 4B:
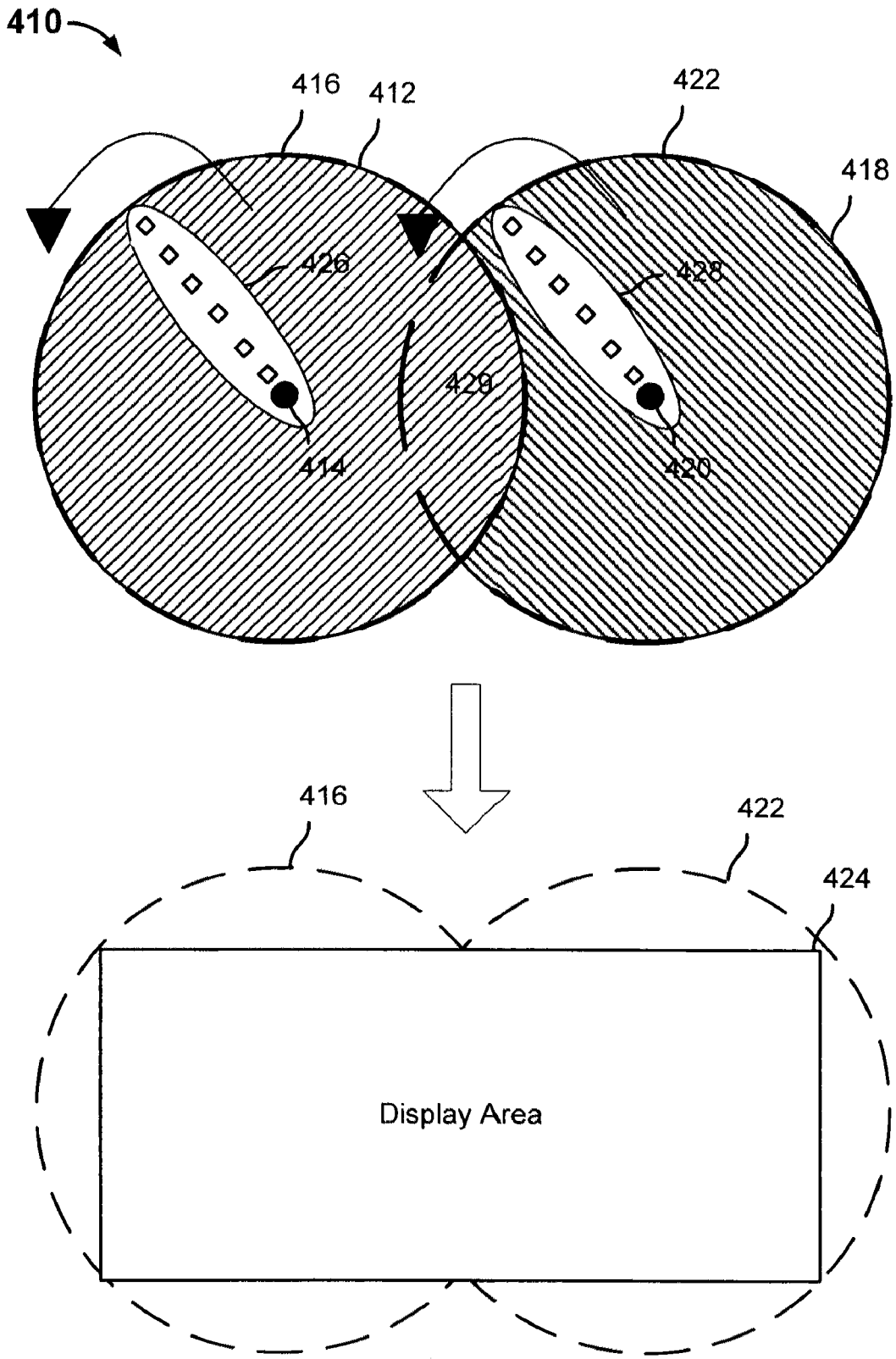
FIG. 4B is a diagram illustrating an embodiment of a composite display 410 that uses masks.

FIG. 4B is a diagram illustrating an embodiment of a composite display 410 that uses masks. In the example shown, paddle 426 is configured to rotate at one end about axis of rotation 414 at a given frequency, such as 60 Hz. A plurality of pixel elements, such as LEDs, is installed on paddle 426. Paddle 426 sweeps out area 416 (bold dashed line) during one rotation or paddle cycle. Paddle 428 is configured to rotate at one end about axis of rotation 420 at a given frequency, such as 60 Hz. Paddle 428 sweeps out area 422 (bold dashed line) during one rotation or paddle cycle. A plurality of pixel elements, such as LEDs, is installed on paddle 428.

In this example, mask 412 (solid line) is used behind paddle 426. In this case, mask 412 is the same shape as area 416 (i.e., a circle). Mask 412 masks light from pixel elements on paddle 428 from leaking into sweep area 416. Mask 412 may be installed behind paddle 426. In some embodiments, mask 412 is attached to paddle 426 and spins around axis of rotation 414 together with paddle 426. In some embodiments, mask 412 is installed behind paddle 426 and is stationary with respect to paddle 426. In this example, mask 418 (solid line) is similarly installed behind paddle 428.

In various embodiments, mask 412 and/or mask 418 may be made out of a variety of materials and have a variety of colors. For example, masks 412 and 418 may be black and made out of plastic.

The display area for showing the image or video may have any shape. The union of swept areas 416 and 422 is the maximum display area. A rectangular image or video may be displayed in rectangular display area 424 as shown.

Areas 416 and 422 overlap. As used herein, two elements (e.g., sweep area, sweep plane, mask, pixel element) overlap if they intersect in an x-y projection. In other words, if the areas are projected onto an x-y plane (defined by the x and y axes, where the x and y axes are in the plane of the figure), they intersect each other. Areas 416 and 422 do not sweep the same plane (do not have the same values of z, where the z axis is normal to the x and y axes), but they overlap each other in overlapping portion 429. In this example, mask 412 occludes sweep area 422 at overlapping portion 429 or occluded area 429. Mask 412 occludes sweep area 429 because it overlaps sweep area 429 and is on top of sweep area 429.

Figure 4C:
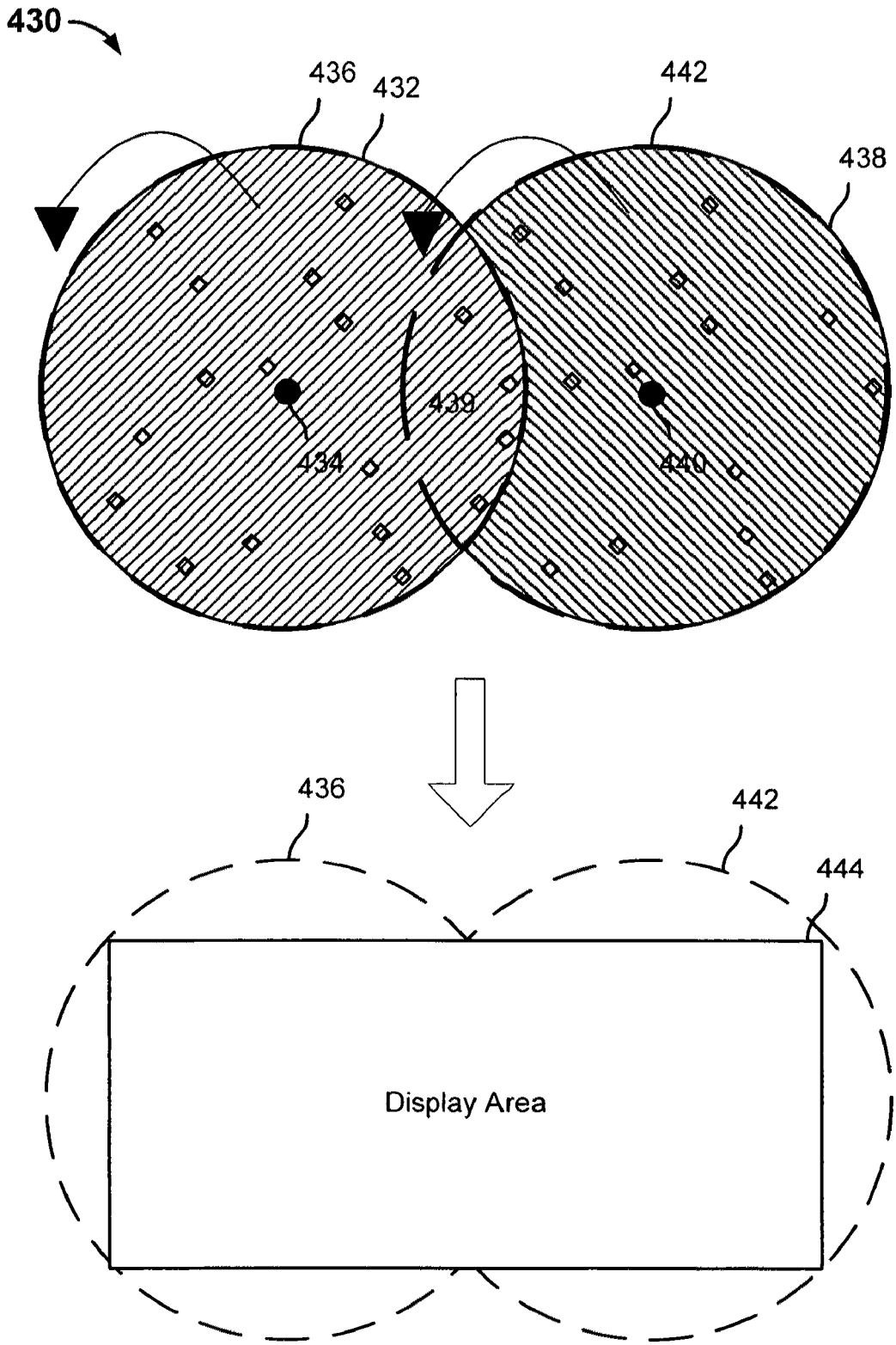
FIG. 4C is a diagram illustrating an embodiment of a composite display 430 that uses masks.

FIG. 4C is a diagram illustrating an embodiment of a composite display 430 that uses masks. In this example, pixel elements are attached to a rotating disc that functions as both a mask and a structure for the pixel elements. Disc 432 can be viewed as a circular shaped paddle. In the example shown, disc 432 (solid line) is configured to rotate at one end about axis of rotation 434 at a given frequency, such as 60 Hz. A plurality of pixel elements, such as LEDs, is installed on disc 432. Disc 432 sweeps out area 436 (bold dashed line) during one rotation or disc cycle. Disc 438 (solid line) is configured to rotate at one end about axis of rotation 440 at a given frequency, such as 60 Hz. Disc 438 sweeps out area 442 (bold dashed line) during one rotation or disc cycle. A plurality of pixel elements, such as LEDs, is installed on disc 438.

In this example, the pixel elements can be installed anywhere on discs 432 and 438. In some embodiments, pixel elements are installed on discs 432 and 438 in the same pattern. In other embodiments, different patterns are used on each disc. In some embodiments, the density of pixel elements is lower towards the center of each disc so the density of temporal pixels is more uniform than if the density of pixel elements is the same throughout the disc. In some embodiments, pixel elements are placed to provide redundancy of temporal pixels (i.e., more than one pixel is placed at the same radius). Having more pixel elements per pixel means that the rotation speed can be reduced. In some embodiments, pixel elements are placed to provide higher resolution of temporal pixels.

Disc 432 masks light from pixel elements on disc 438 from leaking into sweep area 436. In various embodiments, disc 432 and/or disc 438 may be made out of a variety of materials and have a variety of colors. For example, discs 432 and 438 may be black printed circuit board on which LEDs are installed.

The display area for showing the image or video may have any shape. The union of swept areas 436 and 442 is the maximum display area. A rectangular image or video may be displayed in rectangular display area 444 as shown.

Areas 436 and 442 overlap in overlapping portion 439. In this example, disc 432 occludes sweep area 442 at overlapping portion or occluded area 439.

In some embodiments, pixel elements are configured to not be activated when they are occluded. For example, the pixel elements installed on disc 438 are configured to not be activated when they are occluded, (e.g., overlap with occluded area 439). In some embodiments, the pixel elements are configured to not be activated in a portion of an occluded area. For example, an area within a certain distance from the edges of occluded area 439 is configured to not be activated. This may be desirable in case a viewer is to the left or right of the center of the display area and can see edge portions of the occluded area.

Figure 5:
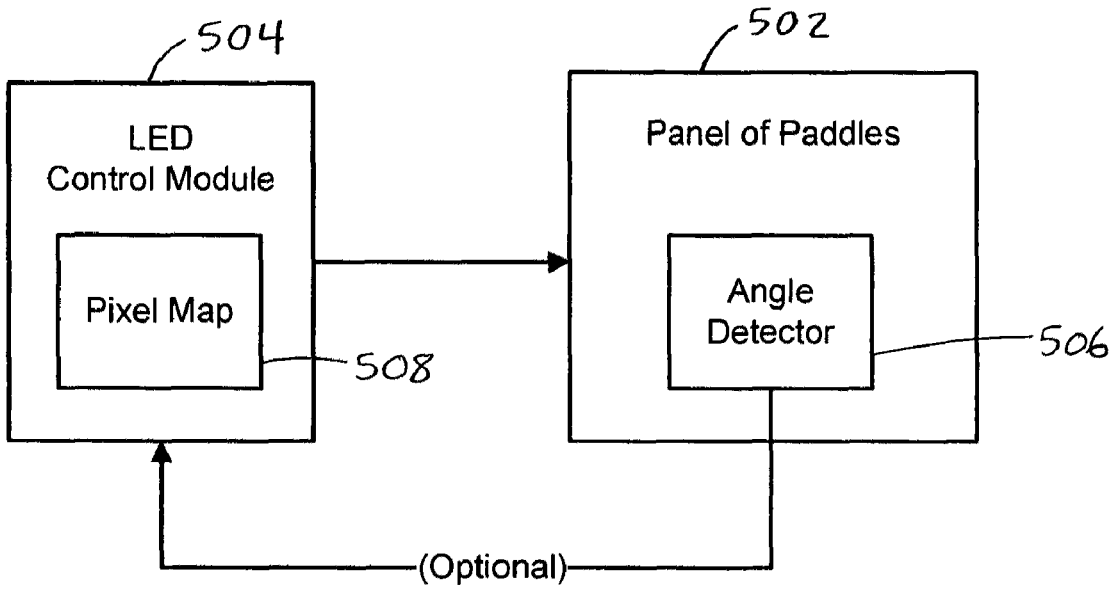
FIG. 5 is a block diagram illustrating an embodiment of a system for displaying an image.

FIG. 5 is a block diagram illustrating an embodiment of a system for displaying an image. In the example shown, panel of paddles 502 is a structure comprising one or more paddles. As more fully described below, panel of paddles 502 may include a plurality of paddles, which may include paddles of various sizes, lengths, and widths; paddles that rotate about a midpoint or an endpoint; paddles that rotate in the same sweep plane or in different sweep planes; paddles that rotate in phase or out of phase with each other; paddles that have multiple arms; and paddles that have other shapes. Panel of paddles 502 may include all identical paddles or a variety of different paddles. The paddles may be arranged in a grid or in any other arrangement. In some embodiments, the panel includes angle detector 506, which is used to detect angles associated with one or more of the paddles. In some embodiments, there is an angle detector for each paddle on panel of paddles 502. For example, an optical detector may be mounted near a paddle to detect its current angle.

LED control module 504 is configured to optionally receive current angle information (e.g., angle(s) or information associated with angle(s)) from angle detector 506. LED control module 504 uses the current angles to determine LED control data to send to panel of paddles 502. The LED control data indicates which LEDs should be activated at that time (sector). In some embodiments, LED control module 504 determines the LED control data using pixel map 508. In some embodiments, LED control module 504 takes an angle as input and outputs which LEDs on a paddle should be activated at that sector for a particular image. In some embodiments, an angle is sent from angle detector 506 to LED control module 504 for each sector (e.g., just prior to the paddle reaching the sector). In some embodiments, LED control data is sent from LED control module 504 to panel of paddles 502 for each sector.

In some embodiments, pixel map 508 is implemented using a lookup table, as more fully described below. For different images, different lookup tables are used. Pixel map 508 is more fully described below.

In some embodiments, there is no need to read an angle using angle detector 506. Because the angular velocity of the paddles and an initial angle of the paddles (at that angular velocity) can be predetermined, it can be computed at what angle a paddle is at any given point in time. In other words, the angle can be determined based on the time. For example, if the angular velocity is ω, the angular location after time t is $\theta_{initial}+\omega t$ where $\theta_{initial}$ is an initial angle once the paddle is spinning at steady state. As such, LED control module can serially output LED control data as a function of time (e.g., using a clock), rather than use angle measurements output from angle detector 506. For example, a table of time (e.g., clock cycles) versus LED control data can be built.

In some embodiments, when a paddle is starting from rest, it goes through a start up sequence to ramp up to the steady state angular velocity. Once it reaches the angular velocity, an initial angle of the paddle is measured in order to compute at what angle the paddle is at any point in time (and determine at what point in the sequence of LED control data to start).

In some embodiments, angle detector 506 is used periodically to provide adjustments as needed. For example, if the angle has drifted, the output stream of LED control data can be shifted. In some embodiments, if the angular speed has drifted, mechanical adjustments are made to adjust the speed.

Figure 6A:
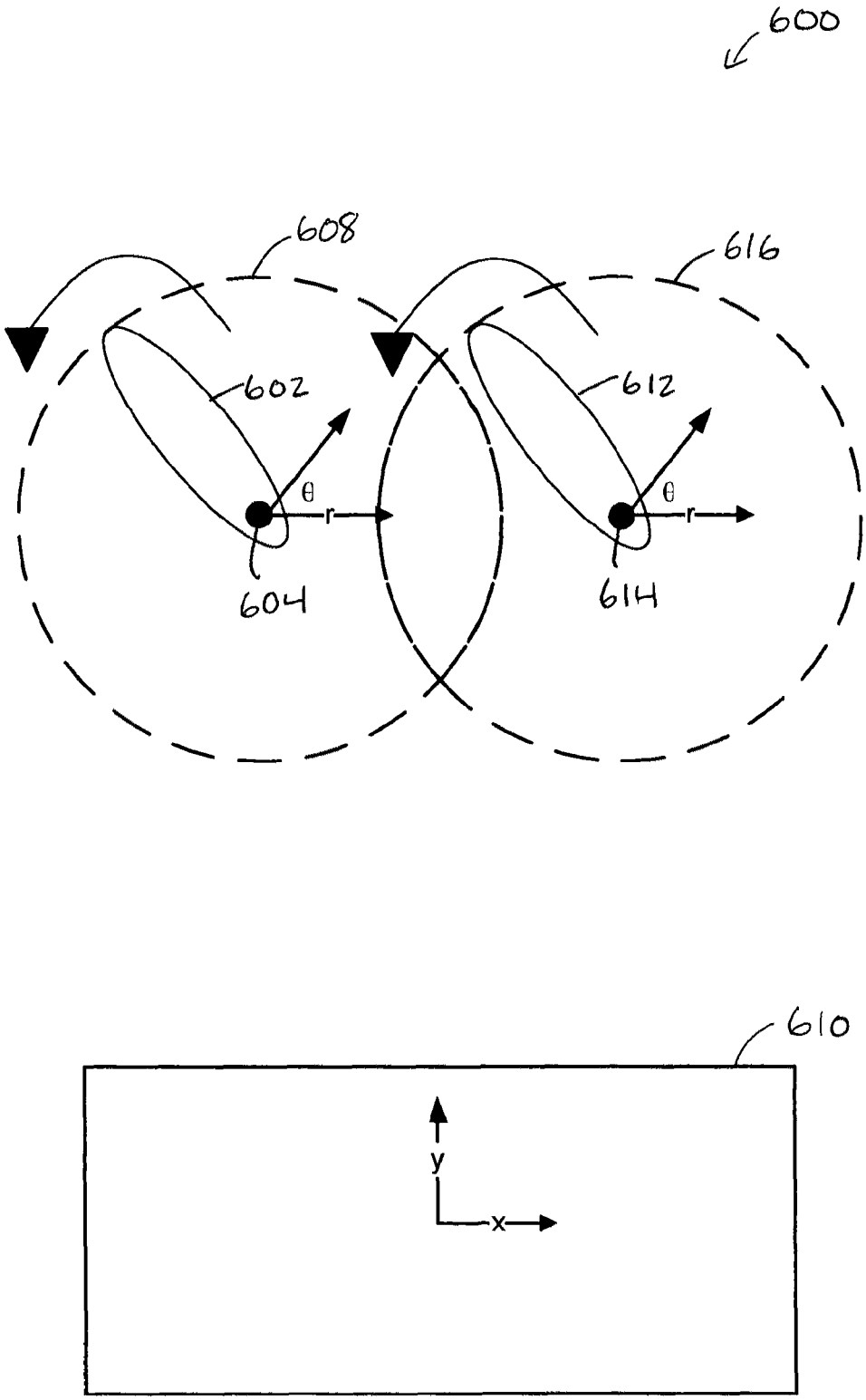
FIG. 6A is a diagram illustrating an embodiment of a composite display 600 having two paddles.

FIG. 6A is a diagram illustrating an embodiment of a composite display 600 having two paddles. In the example shown, a polar coordinate system is indicated over each of areas 608 and 616, with an origin located at each axis of rotation 604 and 614. In some implementations, the position of each LED on paddles 602 and 612 is recorded in polar coordinates. The distance from the origin to the LED is the radius r. The paddle angle is θ. For example, if paddle 602 is in the 3 o'clock position, each of the LEDs on paddle 602 is at 0 degrees. If paddle 602 is in the 12 o'clock position, each of the LEDs on paddle 602 is at 90 degrees. In some embodiments, an angle detector is used to detect the current angle of each paddle. In some embodiments, a temporal pixel is defined by P, r, and θ, where P is a paddle identifier and (r, θ) are the polar coordinates of the LED.

A rectangular coordinate system is indicated over an image 610 to be displayed. In this example, the origin is located at the center of image 610, but it may be located anywhere depending on the implementation. In some embodiments, pixel map 508 is created by mapping each pixel in image 610 to one or more temporal pixels in display area 608 and 616. Mapping may be performed in various ways in various embodiments.

Figure 6B:
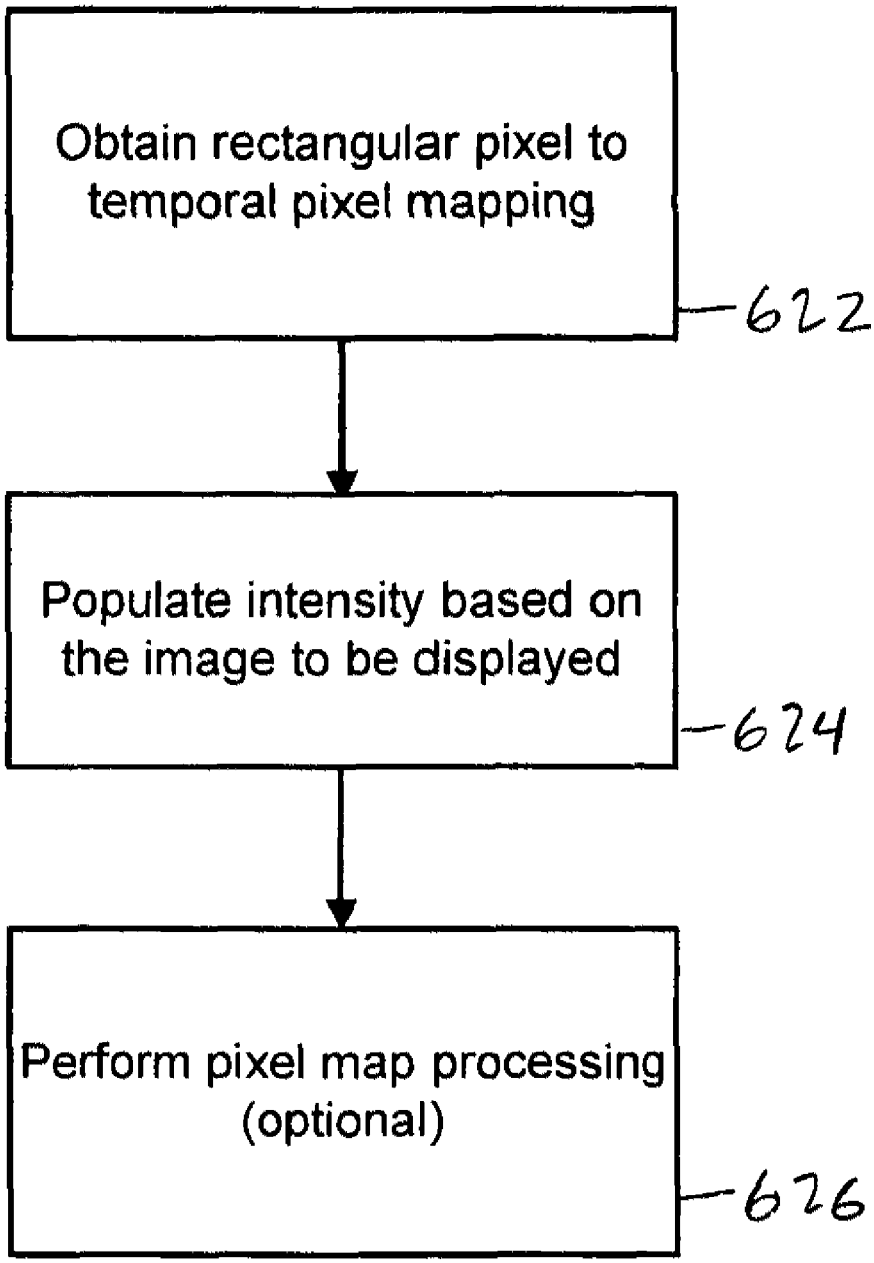
FIG. 6B is a flowchart illustrating an embodiment of a process for generating a pixel map.

FIG. 6B is a flowchart illustrating an embodiment of a process for generating a pixel map. For example, this process may be used to create pixel map 508. At 622, an image pixel to temporal pixel mapping is obtained. In some embodiments, mapping is performed by overlaying image 610 (with its rectangular grid of pixels (x, y) corresponding to the resolution of the image) over areas 608 and 616 (with their two polar grids of temporal pixels (r, θ), e.g., see FIG. 2B). For each image pixel (x, y), it is determined which temporal pixels are within the image pixel. The following is an example of a pixel map:

TABLE 1

| Image pixel (x, y) | Temporal Pixel (P, r, θ) | Intensity (f) |
|---|---|---|
| (a1, a2) | (b1, b2, b3) | |
| (a3, a4) | (b4, b5, b6); (b7, b8, b9) | |
| (a5, a6) | (b10, b11, b12) | |
| etc. | etc. | |

As previously stated, one image pixel may map to multiple temporal pixels as indicated by the second row. In some embodiments, instead of r, an index corresponding to the LED is used. In some embodiments, the image pixel to temporal pixel mapping is precomputed for a variety of image sizes and resolutions (e.g., that are commonly used).

At 624, an intensity f is populated for each image pixel based on the image to be displayed. In some embodiments, f indicates whether the LED should be on (e.g., 1) or off (e.g., 0). For example, in a black and white image (with no grayscale), black pixels map to f=1 and white pixels map to f=0. In some embodiments, f may have fractional values. In some embodiments, f is implemented using duty cycle management. For example, when f is 0, the LED is not activated for that sector time. When f is 1, the LED is activated for the whole sector time. When f is 0.5, the LED is activated for half the sector time. In some embodiments, f can be used to display grayscale images. For example, if there are 256 gray levels in the image, pixels with gray level 128 (half luminance) would have f=0.5. In some embodiments, rather than implement f using duty cycle (i.e., pulse width modulated), f is implemented by adjusting the current to the LED (i.e., pulse height modulation).

For example, after the intensity f is populated, the table may appear as follows:

TABLE 2

| Image pixel (x, y) | Temporal Pixel (P, r, θ) | Intensity (f) |
|---|---|---|
| (a1, a2) | (b1, b2, b3) | f1 |
| (a3, a4) | (b4, b5, b6); (b7, b8, b9) | f2 |
| (a5, a6) | (b10, b11, b12) | f3 |
| etc. | etc. | etc. |

At 626, optional pixel map processing is performed. This may include compensating for overlap areas, balancing luminance in the center (i.e., where there is a higher density of temporal pixels), balancing usage of LEDs, etc. For example, when LEDs are in an overlap area (and/or on a boundary of an overlap area), their duty cycle may be reduced. For example, in composite display 300, when LEDs are in overlap area 318, their duty cycle is halved. In some embodiments, there are multiple LEDs in a sector time that correspond to a single image pixel, in which case, fewer than all the LEDs may be activated (i.e., some of the duty cycles may be set to 0). In some embodiments, the LEDs may take turns being activated (e.g., every N cycles where N is an integer), e.g., to balance usage so that one doesn't burn out earlier than the others. In some embodiments, the closer the LEDs are to the center (where there is a higher density of temporal pixels), the lower their duty cycle.

For example, after luminance balancing, the pixel map may appear as follows:

TABLE 3

| Image pixel (x, y) | Temporal Pixel (P, r, θ) | Intensity (f) |
|---|---|---|
| (a1, a2) | (b1, b2, b3) | f1 |
| (a3, a4) | (b4, b5, b6) | f2 |
| (a5, a6) | (b10, b11, b12) | f3 |
| etc. | etc. | etc. |

As shown, in the second row, the second temporal pixel was deleted in order to balance luminance across the pixels. This also could have been accomplished by halving the intensity to f2/2. As another alternative, temporal pixel (b4, b5, b6) and (b7, b8, b9) could alternately turn on between cycles. In some embodiments, this can be indicated in the pixel map. The pixel map can be implemented in a variety of ways using a variety of data structures in different implementations.

For example, in FIG. 5, LED control module 504 uses the temporal pixel information (P, r, θ, and f) from the pixel map. LED control module 504 takes θ as input and outputs LED control data P, r, and f. Panel of paddles 502 uses the LED control data to activate the LEDs for that sector time. In some embodiments, there is an LED driver for each paddle that uses the LED control data to determine which LEDs to turn on, if any, for each sector time.

Any image (including video) data may be input to LED control module 504. In various embodiments, one or more of 622, 624, and 626 may be computed live or in real time, i.e., just prior to displaying the image. This may be useful for live broadcast of images, such as a live video of a stadium. For example, in some embodiments, 622 is precomputed and 624 is computed live or in real time. In some implementations, 626 may be performed prior to 622 by appropriately modifying the pixel map. In some embodiments, 622, 624, and 626 are all precomputed. For example, advertising images may be precomputed since they are usually known in advance.

The process of FIG. 6B may be performed in a variety of ways in a variety of embodiments. Another example of how 622 may be performed is as follows. For each image pixel (x, y), a polar coordinate is computed. For example, (the center of the image pixel is converted to polar coordinates for the sweep areas it overlaps with (there may be multiple sets of polar coordinates if the image pixel overlaps with an overlapping sweep area). The computed polar coordinate is rounded to the nearest temporal pixel. For example, the temporal pixel whose center is closest to the computed polar coordinate is selected. (If there are multiple sets of polar coordinates, the temporal pixel whose center is closest to the computed polar coordinate is selected.) This way, each image pixel maps to at most one temporal pixel. This may be desirable because it maintains a uniform density of activated temporal pixels in the display area (i.e., the density of activated temporal pixels near an axis of rotation is not higher than at the edges). For example, instead of the pixel map shown in Table 1, the following pixel map may be obtained:

TABLE 4

| Image pixel (x, y) | Temporal Pixel (P, r, θ) | Intensity (f) |
|---|---|---|
| (a1, a2) | (b1, b2, b3) | |
| (a3, a4) | (b7, b8, b9) | |
| (a5, a6) | (b10, b11, b12) | |
| etc. | etc. | |

In some cases, using this rounding technique, two image pixels may map to the same temporal pixel. In this case, a variety of techniques may be used at 626, including, for example: averaging the intensity of the two rectangular pixels and assigning the average to the one temporal pixel; alternating between the first and second rectangular pixel intensities between cycles; remapping one of the image pixel to a nearest neighbor temporal pixel; etc.

Figure 7:
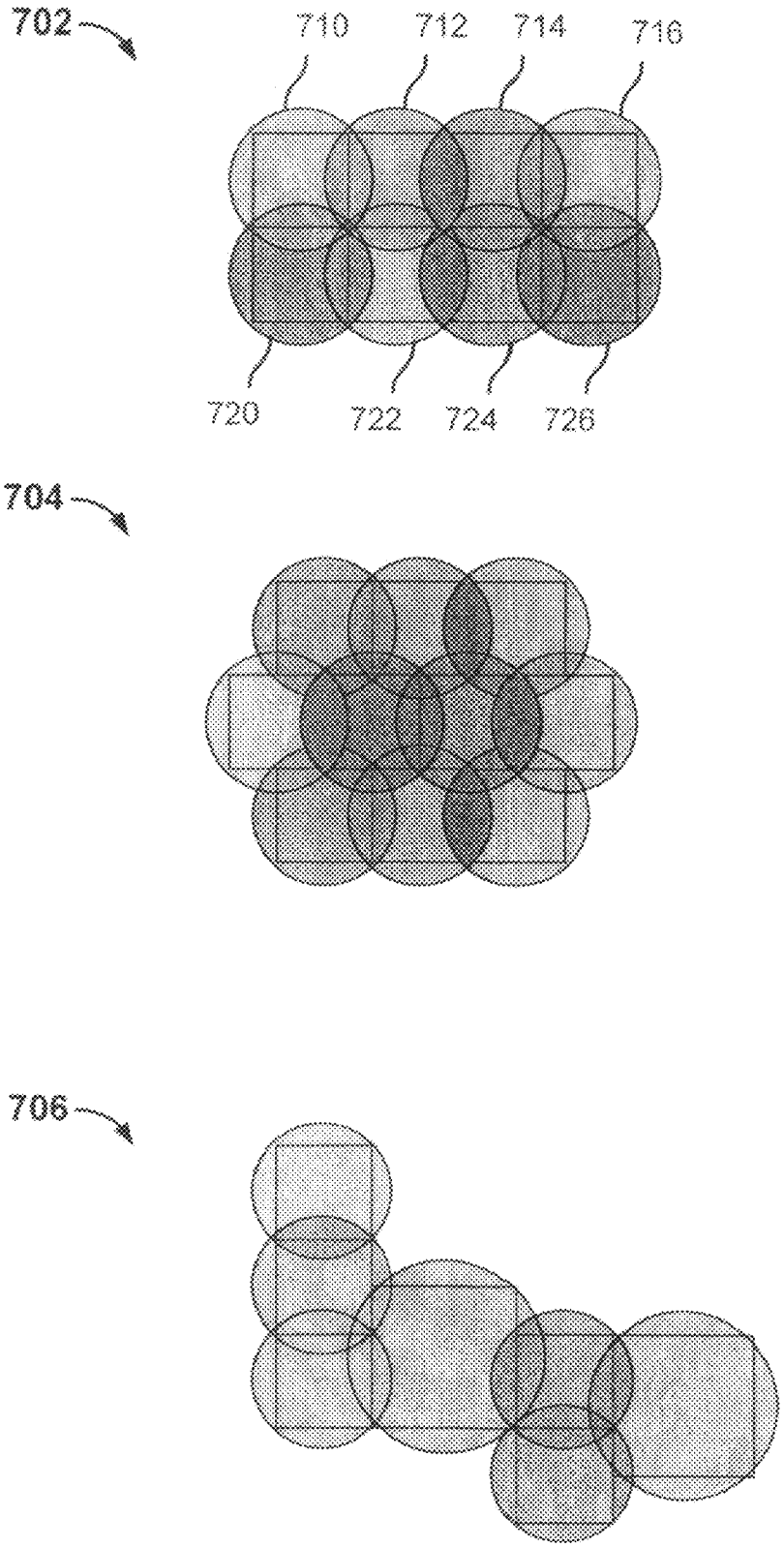
FIG. 7 illustrates examples of paddles arranged in various arrays.

FIG. 7 illustrates examples of paddles arranged in various arrays. For example, any of these arrays may comprise panel of paddles 502. Any number of paddles may be combined in an array to create a display area of any size and shape.

Arrangement 702 shows eight circular sweep areas corresponding to eight paddles each with the same size. The sweep areas overlap as shown. In addition, rectangular display areas are shown over each sweep area. For example, the maximum rectangular display area for this arrangement would comprise the union of all the rectangular display areas shown. To avoid having a gap in the maximum display area, the maximum spacing between axes of rotation is a $\sqrt{2}R$, where R is the radius of one of the circular sweep areas. The spacing between axes is such that the periphery of one sweep area does not overlap with any axes of rotation, otherwise there would be interference. Any combination of the sweep areas and rectangular display areas may be used to display one or more images.

In some embodiments, the eight paddles are in the same sweep plane. In some embodiments, the eight paddles are in different sweep planes. It may be desirable to minimize the number of sweep planes used. For example, it is possible to have every other paddle sweep the same sweep plane. For example, sweep areas 710, 714, 722, and 726 can be in the same sweep plane, and sweep areas 712, 716, 720, and 724 can be in another sweep plane.

In some configurations, sweep areas (e.g., sweep areas 710 and 722) overlap each other. In some configurations, sweep areas are tangent to each other (e.g., sweep areas 710 and 722 can be moved apart so that they touch at only one point). In some configurations, sweep areas do not overlap each other (e.g., sweep areas 710 and 722 have a small gap between them), which is acceptable if the desired resolution of the display is sufficiently low.

Arrangement 704 shows ten circular sweep areas corresponding to ten paddles. The sweep areas overlap as shown. In addition, rectangular display areas are shown over each sweep area. For example, three rectangular display areas, one in each row of sweep areas, may be used, for example, to display three separate advertising images. Any combination of the sweep areas and rectangular display areas may be used to display one or more images.

Arrangement 706 shows seven circular sweep areas corresponding to seven paddles. The sweep areas overlap as shown. In addition, rectangular display areas are shown over each sweep area. In this example, the paddles have various sizes so that the sweep areas have different sizes. Any combination of the sweep areas and rectangular display areas may be used to display one or more images. For example, all the sweep areas may be used as one display area for a non-rectangular shaped image, such as a cut out of a giant serpent.

Figure 8:
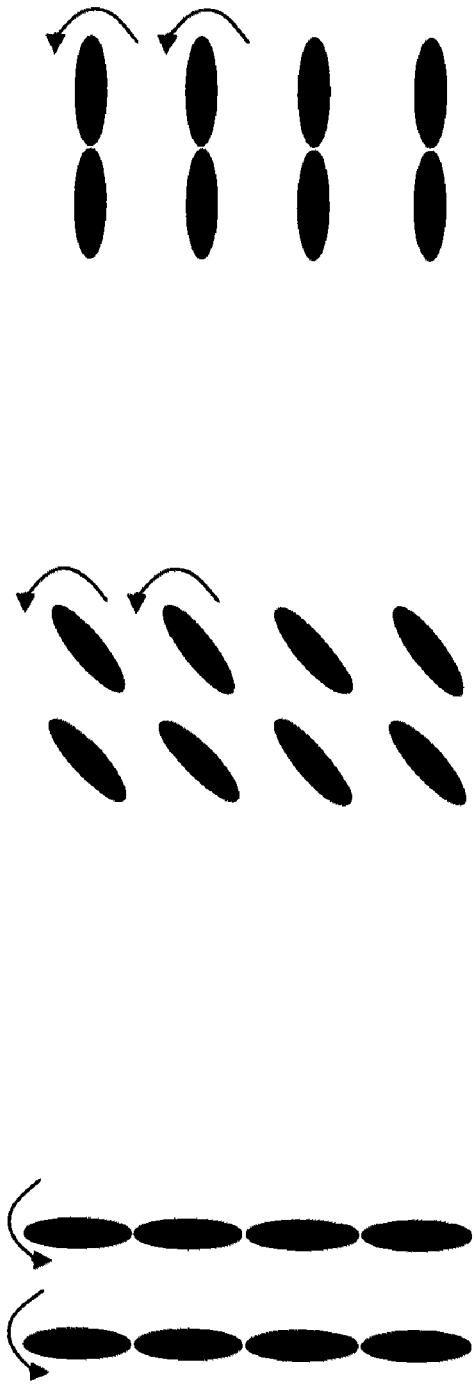
FIG. 8 illustrates examples of paddles with coordinated in phase motion to prevent mechanical interference.

FIG. 8 illustrates examples of paddles with coordinated in phase motion to prevent mechanical interference. In this example, an array of eight paddles is shown at three points in time. The eight paddles are configured to move in phase with each other; that is, at each point in time, each paddle is oriented in the same direction (or is associated with the same angle when using the polar coordinate system described in FIG. 6A).

Figure 9:
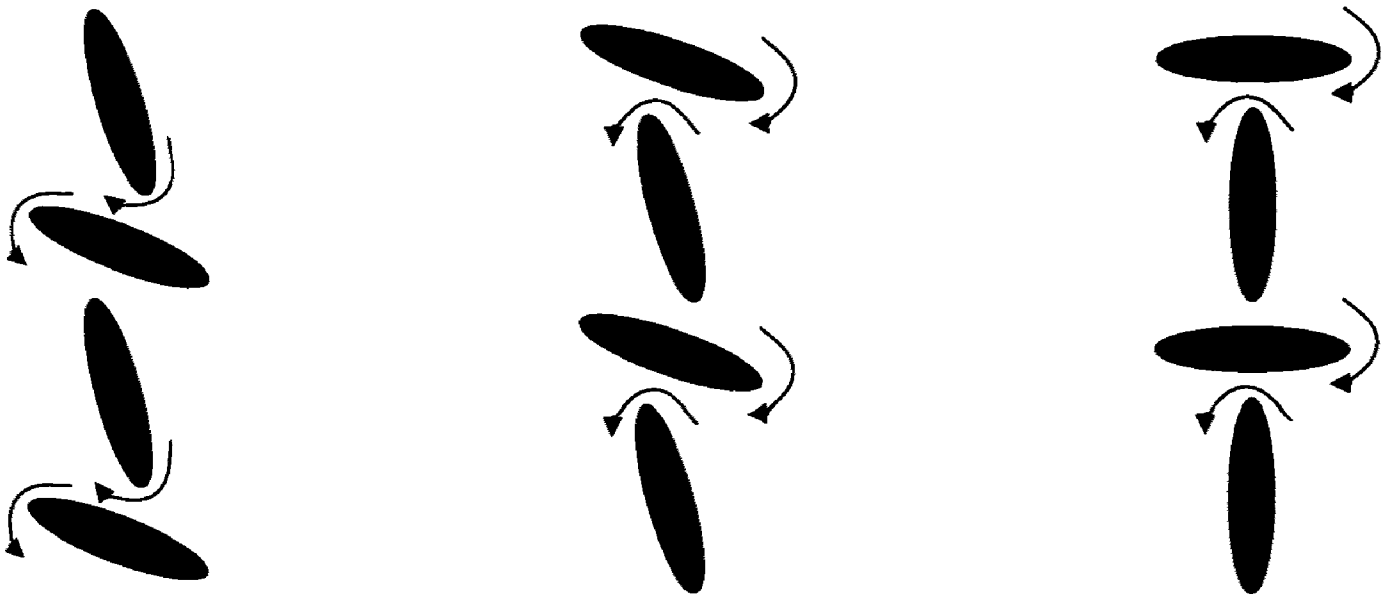
FIG. 9 illustrating examples of paddles with coordinated out of phase motion to prevent mechanical interference.

FIG. 9 illustrating examples of paddles with coordinated out of phase motion to prevent mechanical interference. In this example, an array of four paddles is shown at three points in time. The four paddles are configured to move out of phase with each other; that is, at each point in time, at least one paddle is not oriented in the same direction (or is associated with the same angle when using the polar coordinate system described in FIG. 6A) as the other paddles. In this case, even though the paddles move out of phase with each other, their phase difference (difference in angles) is such that they do not mechanically interfere with each other.

The display systems described herein have a naturally built in cooling system. Because the paddles are spinning, heat is naturally drawn off of the paddles. The farther the LED is from the axis of rotation, the more cooling it receives. In some embodiments, this type of cooling is at least 10× effective as systems in which LED tiles are stationary and in which an external cooling system is used to blow air over the LED tiles using a fan. In addition, a significant cost savings is realized by not using an external cooling system.

Although in the examples herein, the image to be displayed is provided in pixels associated with rectangular coordinates and the display area is associated with temporal pixels described in polar coordinates, the techniques herein can be used with any coordinate system for either the image or the display area.

Although rotational movement of paddles is described herein, any other type of movement of paddles may also be used. For example, a paddle may be configured to move from side to side (producing a rectangular sweep area, assuming the LEDs are aligned in a straight row). A paddle may be configured to rotate and simultaneously move side to side (producing an elliptical sweep area). A paddle may have arms that are configured to extend and retract at certain angles, e.g., to produce a more rectangular sweep area. Because the movement is known, a pixel map can be determined, and the techniques described herein can be applied.

Figure 10:
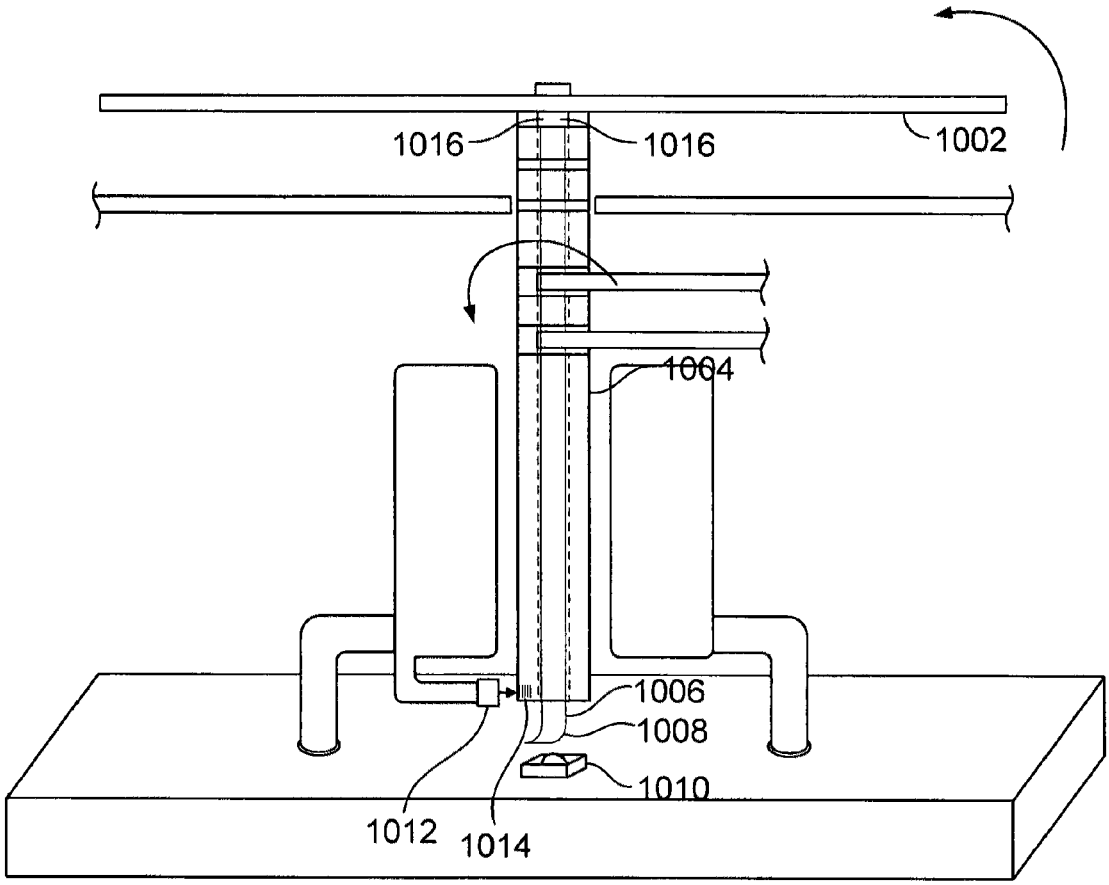
FIG. 10 is a diagram illustrating an example of a cross section of a paddle in a composite display.

FIG. 10 is a diagram illustrating an example of a cross section of a paddle in a composite display. This example is shown to include paddle 1002, shaft 1004, optical fiber 1006, optical camera 1012, and optical data transmitter 1010. Paddle 1002 is attached to shaft 1004. Shaft 1004 is bored out (i.e., hollow) and optical fiber 1006 runs through its center. The base 1008 of optical fiber 1006 receives data via optical data transmitter 1010. The data is transmitted up optical fiber 1006 and transmitted at 1016 to an optical detector (not shown) on paddle 1002. The optical detector provides the data to one or more LED drivers used to activate one or more LEDs on paddle 1002. In some embodiments, LED control data that is received from LED control module 504 is transmitted to the LED driver in this way.

In some embodiments, the base of shaft 1004 has appropriate markings 1014 that are read by optical camera 1012 to determine the current angular position of paddle 1002. In some embodiments, optical camera 1012 is used in conjunction with angle detector 506 to output angle information that is fed to LED control module 508 as shown in FIG. 5.

Figure 11A:
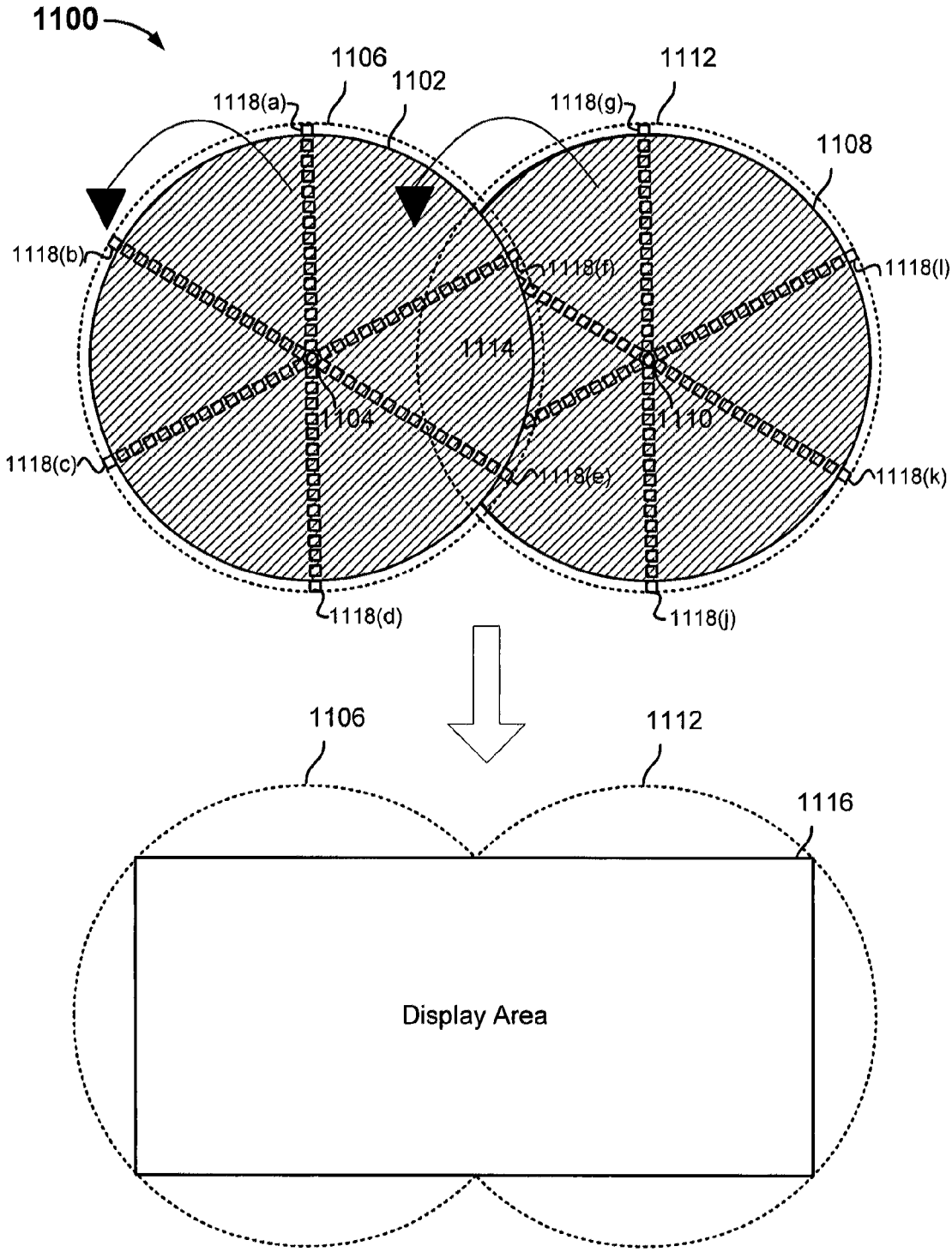
FIG. 11A is a diagram illustrating an embodiment of a composite display 1100 comprised of circularly shaped paddles.

FIG. 11A is a diagram illustrating an embodiment of a composite display 1100 comprised of circularly shaped paddles. In the given example, the paddles comprise rotating discs onto which pixel elements are attached or mounted, with the discs rotating in different sweep planes. Each disc functions as a (e.g., PCB) structure for pixel elements and/or as a mask and is similar to discs 432 and 438 of FIG. 4C. In the example shown, disc 1102 is configured to rotate about axis of rotation 1104 at a given frequency, such as 60 Hz. A plurality of pixel elements, such as LEDs, is installed on disc 1102. Disc 1102 sweeps out area 1106 during one rotation or disc cycle. Disc 1108 is configured to rotate about axis of rotation 1110 at a given frequency, such as 60 Hz. A plurality of pixel elements, such as LEDs, is installed on disc 1108. Disc 1108 sweeps out area 1112 during one rotation or disc cycle. Areas 1106 and 1112 overlap in overlapping portion 1114. In this example, disc 1102 occludes or masks most of sweep area 1112 at overlapping portion or occluded area 1114. The display area for showing the image or video may have any shape. In some embodiments, the union of swept areas 1106 and 1112 is the maximum display area. A rectangular image or video may be displayed in rectangular display area 1116 as shown.

Figure 11B:
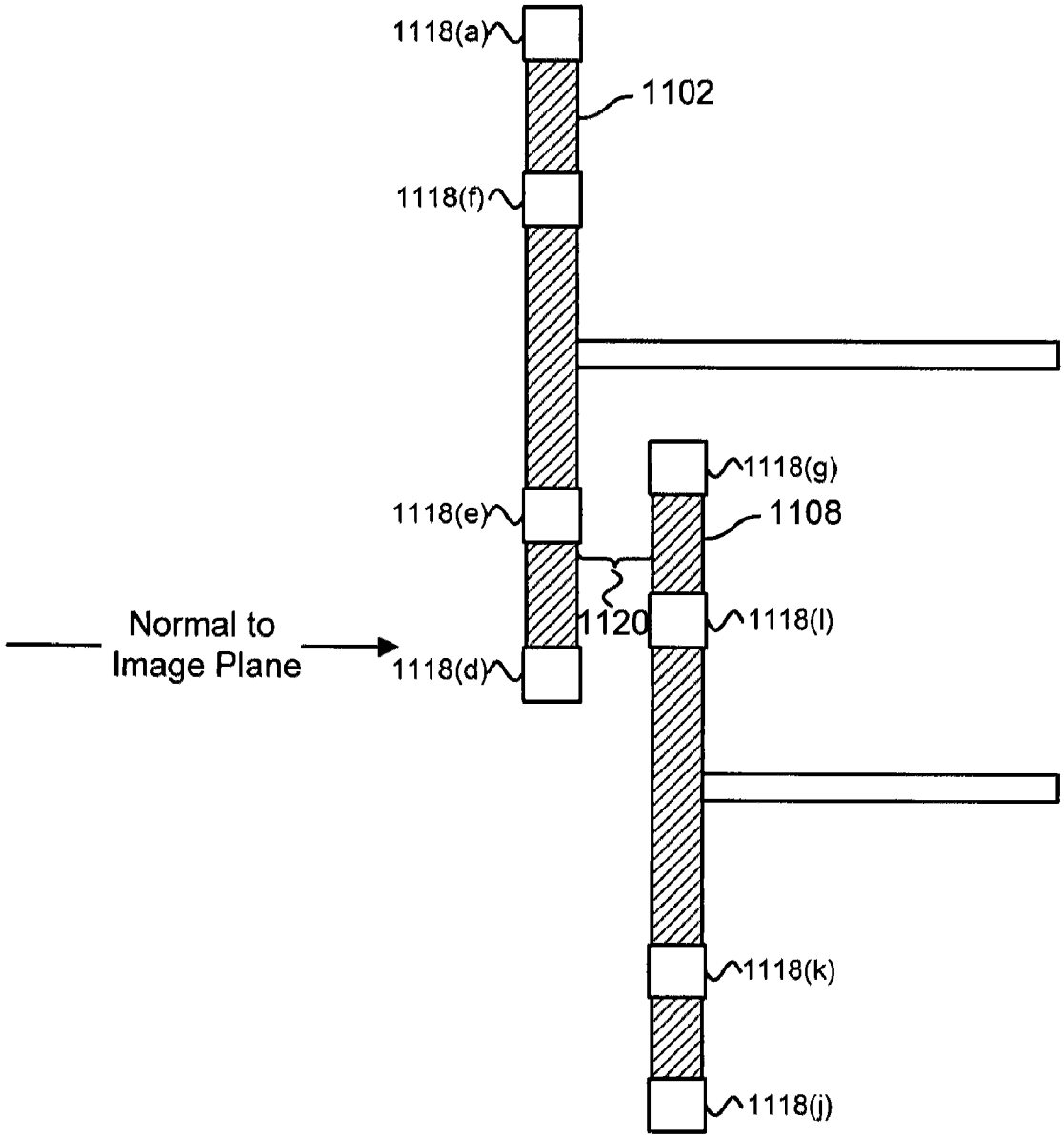
FIG. 11B illustrates an embodiment of a cross section of the composite display of FIG. 11A.

In the given example, pixel elements (e.g., LEDs) are radially installed on discs 1102 and 1108 in six spokes (i.e. one dimensional arrays) although in various embodiments each disc may have any number of spokes or may have other configurations. The number of spokes of pixel elements selected for each disc may be based at least in part on a target rotational rate for the disc, since a larger number of spokes allows a lower rotational rate for a given resolution. In the example of FIG. 11A, a pixel element is installed on the axis of rotation 1104 and 1110 of each disc. In some embodiments, as depicted in the given example, a pixel element 1118 of each spoke at least in part extends beyond or hangs off of the edge of the disc (1102 or 1108). That is, the pixel element 1118 of each spoke is positioned slightly further than the circumference of the disc so that it sweeps out an area (1106 or 1112) larger than the area of the disc. A pixel element installed in such a manner on the edge of a disc is at least partially not backed and/or masked by a disc. Having one or more pixel elements positioned off of the edge of a disc helps in hiding the seam or edge of the disc that may be visible when the composite display is viewed from a position left or right of normal to the display area when an out-of-plane paddle configuration (i.e. paddles that have different sweep planes) is employed. FIG. 11B illustrates an embodiment of a cross section of the composite display of FIG. 11A. When display area 1116 is viewed from an angle other than normal, the pixel elements 1118 installed on the edges of discs 1102 and 1108 help hide visual effects arising from the edges or thicknesses of the discs, the overlapping portions of the discs, and/or the out-of-plane spacing 1120 between the discs. Although described with respect to discs, a similar effect for at least partially hiding visual effects arising from the edges, overlapping portions, and/or out-of-plane spacing of paddles may be achieved by mounting one or more pixel elements off of the edge of any other type of paddle shape and/or structure. Similar techniques may be employed for in-plane paddle configurations (i.e. paddles rotating in the same sweep plane), e.g., to hide the thicknesses of the edges of the paddles.

In various embodiments, disc 1102 and disc 1108 are made out of a variety of materials and have a variety of colors. In some embodiments, each disc 1102 and 1108 comprises a black printed circuit board on which LEDs are mounted. The black color of the printed circuit board aids in enhancing the contrast of an image or a portion of an image generated by the LEDs and minimizes reflections of incident light on the composite display such as from sunlight in an outdoor environment.

Figure 11C:
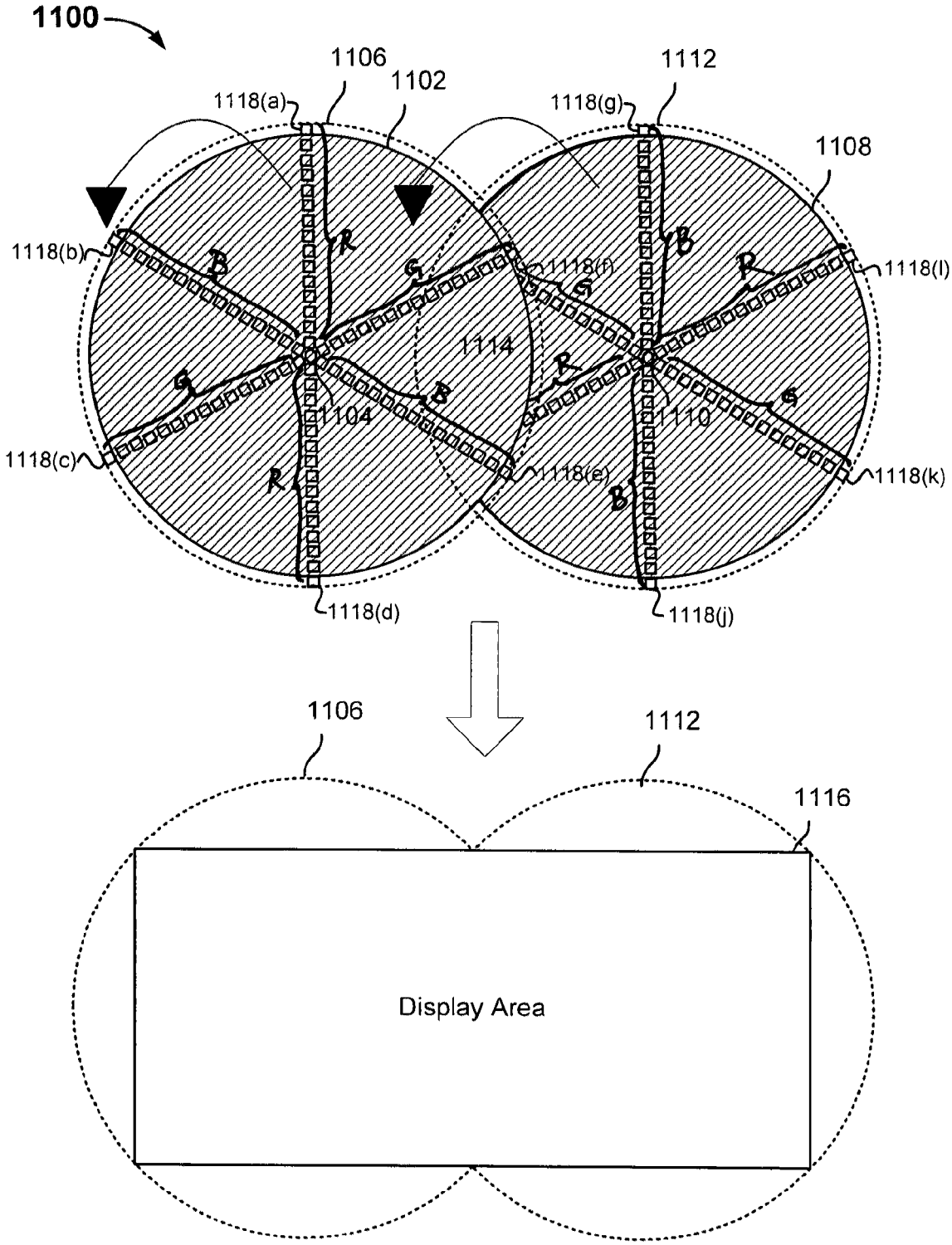
FIG. 11C is a diagram illustrating an embodiment of the composite display of FIG. 11A in which the pixel elements comprise a plurality of colors.

In some embodiments, the pixel elements on each disc comprise one or more colors, for example, so that a color image can be displayed. For instance, in some embodiments, the pixel elements may comprise red, green, and blue LEDs so that a (grayscale) RGB image can be displayed. FIG. 11C is a diagram illustrating an embodiment of the composite display of FIG. 11A in which the pixel elements comprise a plurality of colors. As depicted in the given example, each spoke of discs 1102 and 1108 is comprised of either red, green, or blue pixel elements. The central pixel element of each disc at the axis of rotation of the disc in some embodiments comprises a pixel element capable of producing red, green, or blue light, such as a tri-color RGB LED. In other embodiments, pixels elements of one or more colors may be arranged in any appropriate manner on any paddle shape used in a composite display.

The sweep location of a pixel element installed on a paddle of a composite display configured to sweep out an area varies with time and/or angle. Each temporal pixel of a composite display corresponds to a pixel element at a given sweep location. In various embodiments, any appropriate density or resolution of temporal pixels may be selected for the display. In some cases, the density or resolution of temporal pixels may not be uniform (i.e. may vary) across the display. Any desired grid density and/or resolution of a display may be obtained by appropriately selecting the number/placement of pixel elements and/or the rotation rate (i.e. sector time) of each paddle comprising the display.

Figure 12A:
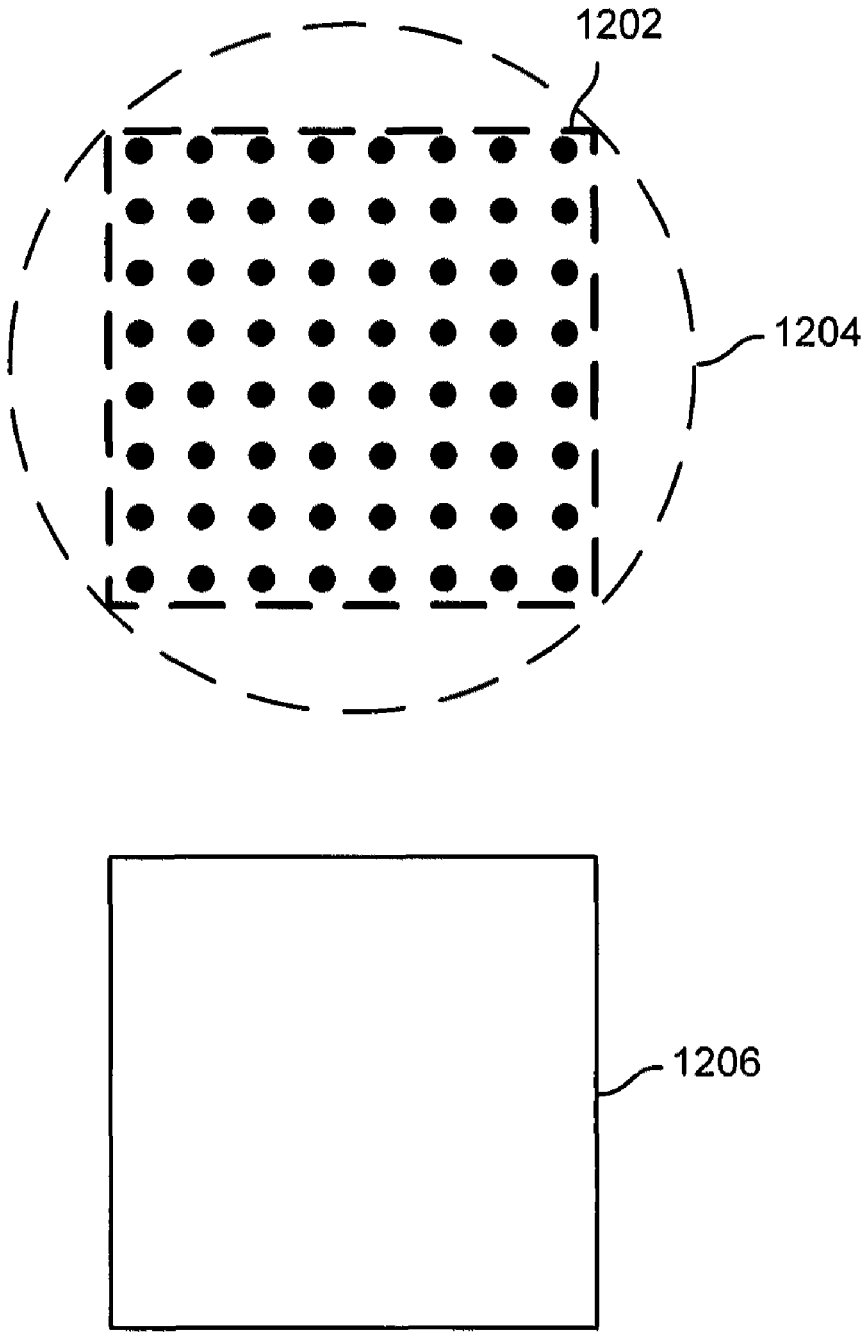
FIG. 12A illustrates an embodiment of a grid of temporal pixels available for rendering an image or portion thereof in a display area 1202 of a composite display.
Figure 12B:
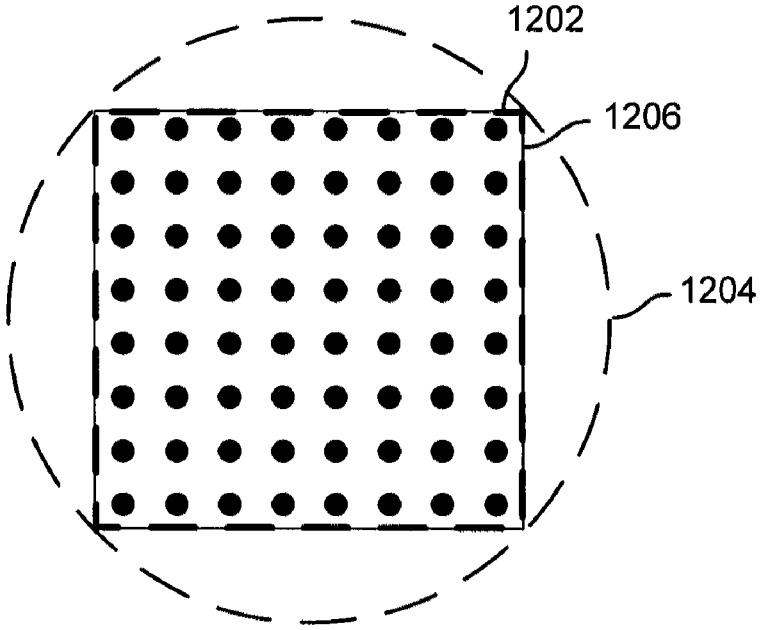
FIG. 12B illustrates an example of rendering an image or portion thereof in a display area of a composite display.
Figure 12C:
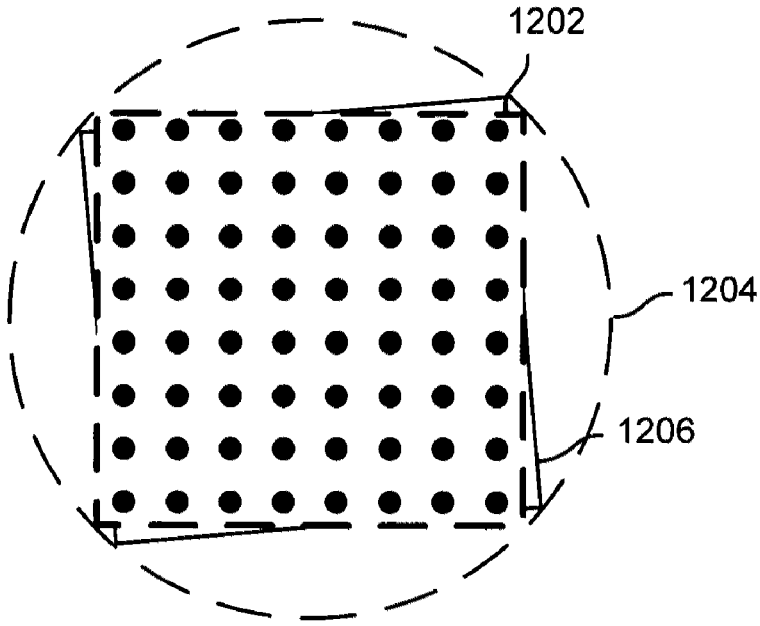
FIG. 12C illustrates an example of an angular misalignment in rendering an image or portion thereof in a display area of a composite display.

FIG. 12A illustrates an embodiment of a grid of temporal pixels available for rendering an image or portion thereof in a display area 1202 of a composite display having a single paddle with a circular sweep area 1204. For example, display area 1202 corresponds to display area 110 of FIG. 1. One or more of the temporal pixels included in the grid may be employed to render an image 1206 (or a portion of the image or an image pixel of the image) in display area 1202. In the given example, the temporal pixels are aligned in rows and columns. Since the alignment of the grid gives the eye vertical and horizontal reference points in the plane of the display, in some cases, an image rendered using such an aligned grid is vulnerable to showing misalignments in image orientation and/or angular rotation. For example, suppose that the image (or portion of the image) 1206 is desired to be rendered in display area 1202. Ideally, as depicted in FIG. 12B, the image 1206 (solid line) should overlap with the image rendered in display area 1202 (bold dashed line). If there is some misalignment in the angular orientation of the rendered image, however, the image rendered in display area 1202 (bold dashed line) may overlap with a rotated version of image 1206 (solid line) as depicted in FIG. 12C. In some cases, for instance, a net angular rotation may result from imprecision in the image pixel to temporal pixel(s) mapping and/or the rendering technique used for the display. In some cases, such an angular rotation in a rendered image may be acceptable, such as in a composite display comprising a single paddle. However, when an image is rendered by a composite display comprising a plurality of paddles, any angular rotations in portions of the image rendered by each paddle may cause the composite image rendered by the composite display to appear distorted.

In some embodiments, instead of an aligned grid as depicted in FIGS. 12A-C, a grid of stochastically arranged temporal pixels is employed so that there is no sense of edges or boundaries and as a result the eye in some cases cannot perceive at least small rotational misalignments in a rendered image or a portion of a rendered image.

Figure 13:
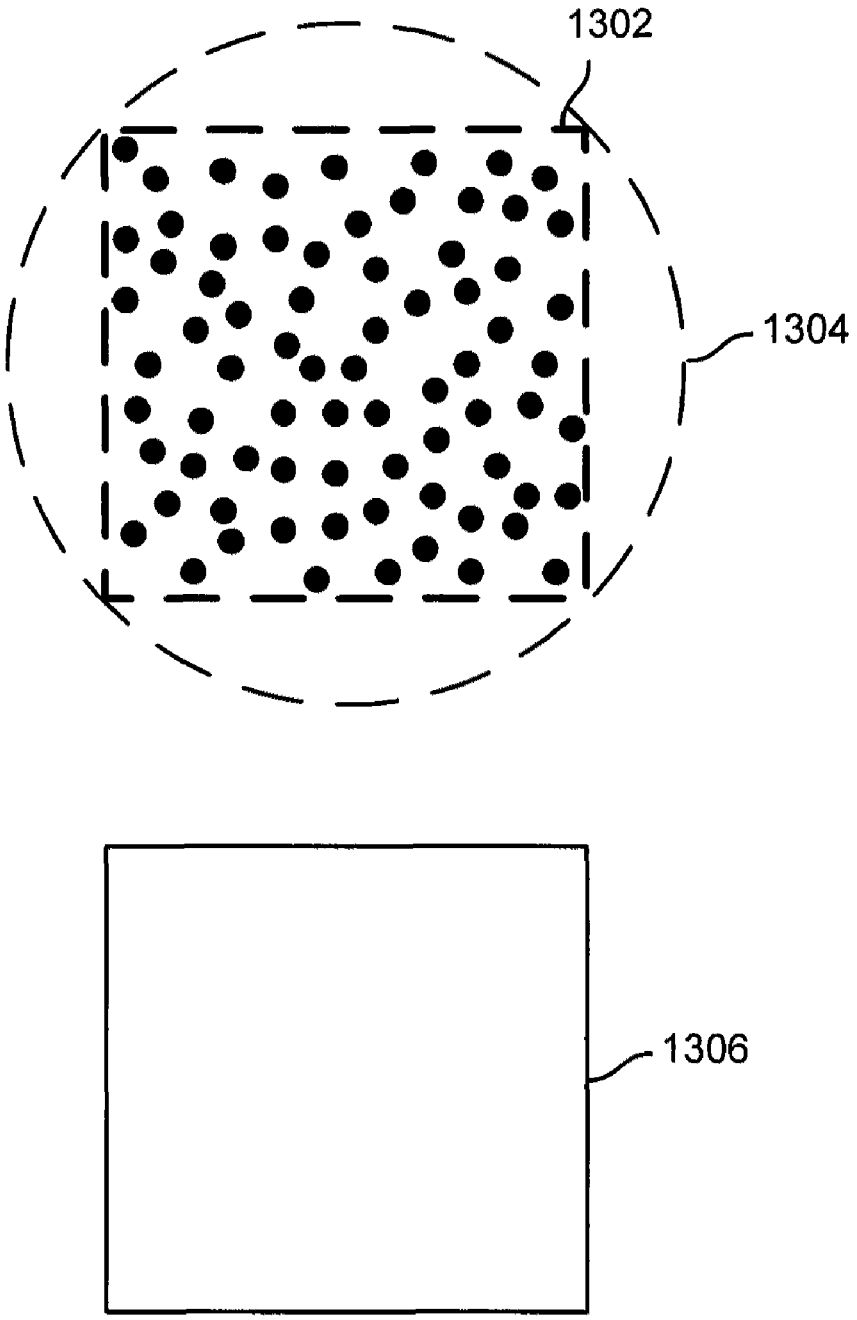
FIG. 13 illustrates an embodiment of a stochastic grid of temporal pixels available for rendering an image or portion thereof in a display area 1302 of a composite display.

FIG. 13 illustrates an embodiment of a grid of temporal pixels available for rendering an image or portion thereof in a display area 1302 of a composite display having a single paddle with a circular sweep area 1304. For example, display area 1302 corresponds to display area 110 of FIG. 1. One or more of the temporal pixels included in the grid may be employed to render an image 1306 (or a portion of the image or an image pixel of the image) in display area 1302. In the given example, the temporal pixels are stochastically (i.e. randomly or pseudo-randomly) arranged. In some embodiments, a stochastic grid of temporal pixels is obtained using a higher resolution (of a in some cases aligned) grid of temporal pixels than needed or desired for the display. In some such cases, for example, the stochastic grid is obtained by randomly selecting a subset of temporal pixels included in such a higher resolution grid. The (average) resolution of the stochastic grid in some such cases is lower than the (average) resolution of the higher resolution grid employed to obtain the stochastic grid. In various embodiments, any desired density, resolution, and/or configuration of a stochastic grid of temporal pixels can be obtained by appropriately selecting the number/placement of pixel elements and/or the rotation rate (i.e. sector time) of a paddle. In various embodiments, in the cases in which a composite display comprises a plurality of paddles, the same and/or different stochastic grid positions may be employed in the display areas associated with the various paddles. Since an image rendered by a stochastic grid of temporal pixels may be invariant to at least slight angular rotations, in some cases it might not be necessary to have an absolute sense of where zero degrees is, for example, when aligning an image or portions of an image over the sweep areas of one or more paddles to determine the image pixel to temporal pixel mapping as described above with respect to the examples of FIGS. 6A-B. A stochastic grid of temporal pixel positions is useful for both in-plane and out-of-plane paddle configurations to mitigate the effects of angular misalignment.

Various techniques including the aforementioned technique of mounting one or more pixel elements on the edges of paddles as described with respect to FIGS. 11A-C may be employed to mitigate visual effects arising from the edges, overlapping portions, and/or spacing of two or more paddles in out-of-plane paddle configurations, which may be particularly visible when the image plane of such a composite display is viewed from an angle other than normal. In some embodiments, the resolution of the display and/or the out-of-plane spacing between paddles are appropriately adjusted to eliminate or at least mitigate such visual effects so that an image being displayed appears seamless from any viewing angle. As previously described, to the eye, having two paddles rotate in different sweep planes is not detectable if the resolution of the display is sufficiently smaller than the vertical spacing between the sweep planes. That is, the visual effects arising from out-of-plane paddle configurations are not detectable if the virtual or temporal pixel-to-pixel spacing is larger (i.e. the temporal pixel resolution is sufficiently smaller) than the out-of-plane spacing between paddles. Thus, using a lower resolution (i.e. less dense) grid of temporal pixels for out-of-plane paddle configurations aids in mitigating such visual effects. In some embodiments, any desired grid resolution may be employed for a display comprising an in-plane paddle configuration since in-plane paddle configurations do not suffer from out-of-plane seam issues.

As previously described, during image pixel to temporal pixel mapping, one image pixel may map to a plurality of temporal pixels. When an image pixel maps to multiple temporal pixels, the multiple temporal pixels include one or more redundant temporal pixels each of which may or may not be employed to render the image pixel in various embodiments. Table 5 is an embodiment of a pixel map in which at least some image pixels map to a plurality of temporal pixels. In some embodiments, the pixel map of Table 5 is generated using the process of FIG. 6B. In some embodiments, the mapping of Table 5 is for a grayscale image.

TABLE 5

| Image pixel (x, y) | Temporal Pixel (P, r, θ) | Intensity (f) |
|---|---|---|
| (a1, a2) | (b1, b2, b3) | f1 |
| (a3, a4) | (b4, b5, b6) | f2/2 |
| | (b7, b8, b9) | f2/2 |
| (a5, a6) | (b10, b11, b12) | f3/3 |
| | (b13, b14, b15) | f3/3 |
| | (b16, b17, b18) | f3/3 |
| etc. | etc. | etc. |

In some embodiments, as in the example of Table 5, in the cases in which an image pixel maps to multiple temporal pixels, one or more of the temporal pixels to which the image pixel is mapped are employed to render the image pixel. In some embodiments, the intensity associated with the image pixel is divided in any appropriate manner across the temporal pixels selected to render the image pixel. In the example of Table 5, for instance, the intensity f2 of image pixel (a3, a4) is equally divided between the two temporal pixels to which it maps, and the intensity f3 of image pixel (a5, a6) is equally divided among the three temporal pixels to which it maps. In other embodiments, the intensity may not be equally divided. In some embodiments, the intensity comprises an amplitude and/or a duty cycle. Spreading out the intensity of an image pixel across as many as possible and/or at least a subset of temporal pixels to which it maps prevents or at least mitigates degenerate pixels (i.e. dark spots) from appearing in the rendered image, which may appear in the rendered image, for example, if redundant temporal pixels are not used in the rendering. In some embodiments, all or at least as many as possible temporal pixels to which image pixels are mapped are used to render an image. In some cases two (or more) image pixels may be mapped to one or more of the same temporal pixels. In such cases, a common temporal pixel is employed to at least partially render at least one of the image pixels mapped to it. Spreading out or dividing the intensity of an image pixel across multiple temporal pixels is in some embodiments possible using a driver chip (e.g., for doing pulse width modulation on pixel elements) that has sufficient bit depth to allow the intensity or grayscale value of the image pixel to be spread out across multiple temporal pixels. For example, in some cases, a 12-bit driver provides sufficient bit depth.

In some embodiments, due to the inherent convective cooling arising from the rotation of the paddles, the pixel elements of the paddles can be driven at a higher brightness, for example, to counter or overcome some brightness loss due to the spreading of intensity over multiple temporal pixels, duty cycle management, etc.

In some embodiments, a cover plate as further described below is installed in front of the composite display, for example, to protect the mechanical structure of the composite display and/or prevent external interference. Such a cover plate may be made of any appropriate material, such as plastic.

Various techniques may be employed to enhance or improve the quality of the image being displayed and/or remove or at least mitigate artifacts in the rendered image. In some embodiments, the rendering process for activating temporal pixels is configured to improve the quality of the rendered image and/or mitigate artifacts in the rendered image, for example, using one or more appropriate image processing techniques, such as color space remapping, non-linear gamma correction, fixed pattern dither, error diffusion based dithering, etc. In some embodiments, one or more secondary optics are employed to improve image quality and/or mitigate artifacts.

In some embodiments, diffusion is employed to mitigate artifacts in a rendered image. In some such cases, diffusion of the rendered image is achieved at least in part by mounting a diffuser film in front of the composite display. For example, a diffuser film can be laminated onto the inside surface of the cover plate of the composite display. In some embodiments, diffusion by itself may excessively degrade the image quality, for example, by making the image too blurry. Degradation may occur, for example, if the pixel elements comprise diffused light sources such as LEDs. In such cases, the light emitted by each pixel element diffuses over the distance it travels to reach the diffuser film on the cover plate. Further degradation may occur if an out-of-plane paddle configuration is used for the composite display since the light emitted by pixel elements on out-of-plane paddles travels different distances before reaching the diffuser film on the cover plate. Collimating the light prior to diffusing, for example, using a collimating film in front of the diffuser film on the cover plate does not help in some cases because the light emitted by each pixel element on the paddles has already diffused over the distance it has traveled to reach the collimating film on the cover plate and by different amounts for out-of-plane paddles. In the cases in which the pixel elements comprise diffused light sources, in some embodiments, it is useful to at least substantially locally collimate the light at each pixel element so that the light of each pixel element minimally diffuses over the distance it travels between the pixel element and the diffuser film. In some such cases, a diffuser film can be employed on the inside surface of a cover plate to diffuse the collimated light from the pixel elements hitting it so that visual artifacts in the rendered image can be mitigated. In some embodiments, LEDs packaged with lenslets attached to them that help to locally focus and collimate the light emitted by the LEDs may be used. In some embodiments, however, the thickness of such an LED with an attached lenslet for local collimation is greater than the out-of-plane spacing desired for paddles in a composite display.

In some embodiments, a thin film optic such as a microlens array is employed for local collimation at each pixel element. In some embodiments, such a thin film optic is associated with Fresnel lens characteristics. In some embodiments, the thin film optic is implemented using an embossed film having the desired collimating (e.g., Fresnel) characteristics from which thin film lenses are punched out and adhered onto the outside surface of each pixel element.

Figure 14:
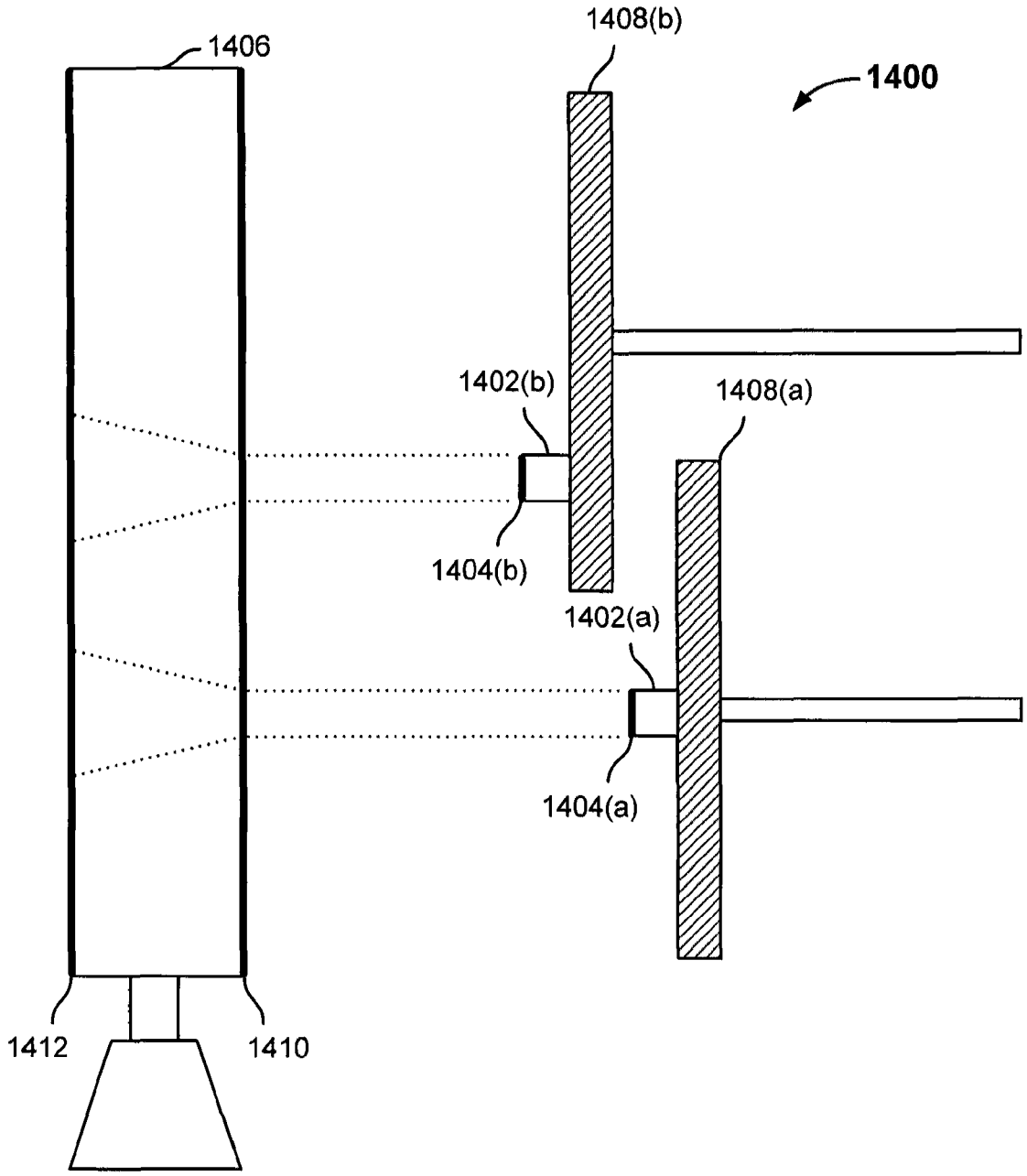
FIG. 14 illustrates an embodiment of a cross section of a composite 1400.

FIG. 14 illustrates an embodiment of a cross section of a composite display 1400. The composite display 1400 of the given example comprises an out-of-plane paddle configuration. In the given example, a thin film collimating lens 1404 is attached to each pixel element 1402 which locally focuses and (substantially) collimates the light emitted by the pixel element 1402. A cover plate 1406 is installed a small distance in front of the paddles 1408 of the composite display 1400, with a diffuser film 1410 laminated on the inside surface of the cover plate 1406. Any dispersion or diffusion of the collimated light over the distance it travels to reach the diffuser film on the cover plate and/or the difference in distance traveled for out-of-plane paddles is in many cases imperceptible to the eye. Upon hitting the diffuser film 1410 on the cover plate 1406, the collimated light is diffused at the image plane, which in some cases facilitates hiding visual artifacts in the image, especially when the display is viewed from a sufficient viewing distance. In some embodiments, local collimation and diffusion at the image plane (e.g., at the cover plate) as described helps hide the seams associated with out-of-plane paddle configurations since collimation of the light of the paddles prior to diffusion makes the out-of-plane spacing between the paddles less perceptible. In some such cases, it may be possible to use higher temporal pixel resolutions since the seams of the out-of-plane paddle configuration are more effectively hidden.

In some embodiments, the outside surface of the cover plate 1406 (optionally) includes an anti-reflective coating 1412. In various embodiments, for example, the anti-reflective coating 1412 may be directly applied to the outer surface of cover plate 1406, may be coated on a film laminated onto the outside surface of cover plate 1406, etc. The anti-reflective coating 1412 helps mitigate interference of reflections of incident light (e.g., sunlight in an outdoor environment) with the light generated by the display.

Although some examples of image quality improvements have been described, any appropriate image processing techniques and/or secondary optics may be employed to improve the quality and/or hide artifacts of the displayed image.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A method comprising:

mapping at least one image pixel to at least two of a plurality of temporal pixels; and rendering, with the plurality of temporal pixels, a plurality of image pixels, wherein:

the first paddle includes a first plurality of pixel elements and is configured to rotate around a first axis such that the first plurality of pixel elements sweeps out a first planar area orthogonal to the first axis;

the second paddle includes a second plurality of pixel elements and is configured to rotate around a second axis such that the second plurality of pixel elements sweeps out a second planar area orthogonal to the second axis, the first planar area and the second planar area overlapping portion and first and second non-overlapping portions, and the first axis being substantially parallel to the second axis;

each temporal pixel corresponds to a pixel element of the first paddle or the second paddle at a given sweep location; and an intensity of the at least one image pixel, based on an image to be displayed, is achieved by spreading out the intensity across the at least two temporal pixels.

2. The method of claim 1, wherein the at least one image pixel is included in an image being rendered in a composite display by the plurality of temporal pixels, including the at least two temporal pixels.

3. The method of claim 1, wherein at least one of the plurality of temporal pixels is a redundant temporal pixel.

4. The method of claim 1, wherein spreading out the intensity across the at least two temporal pixels includes dividing the intensity substantially equally across the at least two temporal pixels.

5. The method of claim 1, wherein spreading out the intensity across the at least two temporal pixels includes dividing the intensity unequally across the at least two temporal pixels.

6. The method of claim 1, wherein the intensity is defined by an amplitude.

7. The method of claim 1, wherein the intensity is defined by a duty cycle.

8. The method of claim 1, wherein the intensity is defined by a grayscale value.

9. The method of claim 1, wherein the at least two temporal pixels are activated so as to emit light by a driver chip that has sufficient bit depth to spread the intensity across the at least two temporal pixels.

10. The method of claim 1, further comprising creating a pixel map.

11. The method of claim 10, wherein the pixel map results from overlaying an image over a display area of a composite display.

12. A system comprising:

a pixel element control module configured to:

map at least one image pixel to at least two of a plurality of temporal pixels; and render, with the plurality of temporal pixels, a plurality of image pixels, wherein:

the first paddle includes a first plurality of pixel elements and is configured to rotate around a first axis such that the first plurality of pixel elements sweeps out a first planar area orthogonal to the first axis;

the second paddle includes a second plurality of pixel elements and is configured to rotate around a second axis such that the second plurality of pixel elements sweeps out a second planar area orthogonal to the second axis, the first planar area and the second planar area include an overlapping portion and first and second non-overlapping portions, and the first axis being substantially parallel to the second axis;

each temporal pixel corresponds to a pixel element of the first paddle or the second paddle at a given sweep location; and an intensity of the at least one image pixel, based on an image to be displayed, is achieved by spreading out the intensity across the at least two temporal pixels.

13. The system of claim 12, wherein the intensity is defined by one or more of an amplitude, a grey scale value, and a duty cycle.

14. The system of claim 12, wherein the at least one image pixel is included in an image being rendered in a composite display by the plurality of temporal pixels, including the at least two temporal pixels.

15. The system of claim 12, wherein at least one of the plurality of temporal pixels is a redundant temporal pixel.

16. The system of claim 12, wherein the intensity is divided substantially equally across the at least two temporal pixels.

17. The system of claim 12, wherein the intensity is defined by a grayscale value.

18. The system of claim 12, wherein the at least two temporal pixels are activated so as to emit light by a driver chip that has sufficient bit depth to spread the intensity across the at least two temporal pixels.

19. The system of claim 12, wherein the processor is further configured to create a pixel map.

20. The system of claim 19, wherein the pixel map results from overlaying an image over a display area of a composite display.

21. The system of claim 12, wherein spreading out the intensity across at least two of the plurality of pixels includes dividing the intensity unequally across the at least two temporal pixels.

22. A tangible computer readable medium wherein computer instructions are stored, the instructions operable to cause a computer to:

map at least one image pixel to at least two of a plurality of temporal pixels; and render, with the plurality of temporal pixels, a plurality of image pixels, wherein:

the first paddle includes a first plurality of pixel elements and is configured to rotate around a first axis such that the first plurality of pixel elements sweeps out a first planar area orthogonal to the first axis;

the second paddle includes a second plurality of pixel elements and is configured to rotate around a second axis such that the second plurality of pixel elements sweeps out a second planar area orthogonal to the second axis, the first planar area and the second planar area include an overlapping portion and first and second non-overlapping portions, and the first axis being substantially parallel to the second axis;

each temporal pixel corresponds to a pixel element of the first paddle or the second paddle at a given sweep location; and an intensity of the at least one image pixel, based on an image to be displayed, is achieved by spreading out the intensity across the at least two temporal pixels.

23. The tangible computer readable medium of claim 22, wherein the intensity is defined by at least one of an amplitude and a duty cycle.

24. The tangible computer readable medium of claim 22, wherein the intensity is divided substantially equally across the at least two temporal pixels.

25. The tangible computer readable medium of claim 22, wherein the at least one image pixel is included in an image being rendered in a composite display by the plurality of temporal pixels, including the at least two temporal pixels.

26. The tangible computer readable medium of claim 22, wherein at least one of the plurality of temporal pixels is a redundant temporal pixel.

27. The tangible computer readable medium of claim 22, wherein the intensity is defined by a grayscale value.

28. The tangible computer readable medium of claim 22, wherein the at least two temporal pixels are activated so as to emit light by a driver chip that has sufficient bit depth to spread the intensity across the at least two temporal pixels.

29. The tangible computer readable medium of claim 22, wherein the instructions are further operable to cause the computer to create a pixel map.

30. The tangible computer readable medium of claim 29, wherein the pixel map results from overlaying an image over a display area of a composite display.

31. The tangible computer readable medium of claim 22, wherein spreading out the intensity across at least two of the plurality of pixels includes dividing the intensity unequally across the at least two temporal pixels.

32. An apparatus comprising:

a first paddle including a first plurality of pixel elements and configured to rotate around a first axis such that the first plurality of pixel elements sweeps out a first planar area orthogonal to the first axis;

a second paddle including a second plurality of pixel elements and configured to rotate around a second axis such that the first plurality of pixel elements sweeps out a second planar area, orthogonal to the second axis, the first planar area and the second planar area including an overlapping portion and a first and second non-overlapping portions, and the first axis being substantially parallel to the second axis; and a pixel element control module configured to:

map at least one image pixel to at least two of a plurality of temporal pixels; and render with the plurality of temporal pixels, a plurality of image pixels, wherein:

each temporal pixel corresponds to a pixel element of the first paddle or the second paddle at a given sweep location; and an intensity of the at least one image pixel, based on an image to be displayed, is achieved by spreading out the intensity across the at least two temporal pixels.

33. The apparatus of claim 32, wherein the at least one image pixel is included in an image being rendered in a composite display by the plurality of temporal pixels, including the at least two temporal pixels.

34. The apparatus of claim 32, wherein at least one of the plurality of temporal pixels is a redundant temporal pixel.

35. The apparatus of claim 32, wherein spreading out the intensity across the at least two temporal pixels includes dividing the intensity substantially equally across the at least two temporal pixels.

36. The apparatus of claim 32, wherein the intensity is defined by one or more of an amplitude, a duty cycle and a grayscale value.

37. The apparatus of claim 32, wherein at least the subset of pixel elements are activated so as to emit light by a driver chip that has sufficient bit depth to spread the intensity across the at least two temporal pixels.

38. The apparatus of claim 32, wherein the processor is further configured to create a pixel map.

39. The apparatus of claim 38, wherein the pixel map results from overlaying an image over a display area of a composite display.

40. The apparatus of claim 32, wherein spreading out the intensity across at least two of the plurality of pixels includes dividing the intensity unequally across the at least two temporal pixels.

* * * * *